US010518945B2

(12) United States Patent
Phillips et al.

(10) Patent No.: US 10,518,945 B2
(45) Date of Patent: Dec. 31, 2019

(54) CLOSURE FOR A CONTAINER

(71) Applicant: AptarGroup, Inc., Crystal Lake, IL (US)

(72) Inventors: Ken Phillips, Mukwonago, WI (US); Curt Prusko, Wauwatosa, WI (US); Kay Stanish, Crystal Lake, IL (US)

(73) Assignee: APTARGROUP, INC., Crystal Lake, IL (US)

( * ) Notice: Subject to any disclaimer, the term of this patent is extended or adjusted under 35 U.S.C. 154(b) by 2 days.

(21) Appl. No.: 15/744,511

(22) PCT Filed: Sep. 28, 2017

(86) PCT No.: PCT/US2017/053885

§ 371 (c)(1),
(2) Date: Jan. 12, 2018

(87) PCT Pub. No.: WO2019/066838

PCT Pub. Date: Apr. 4, 2019

(65) Prior Publication Data

US 2019/0092539 A1 Mar. 28, 2019

(51) Int. Cl.
*B65D 47/20* (2006.01)
*B65D 55/02* (2006.01)

(52) U.S. Cl.
CPC ..... *B65D 47/2006* (2013.01); *B65D 55/024* (2013.01); *B65D 2203/02* (2013.01)

(58) Field of Classification Search
CPC ..... B65D 47/2006; B65D 47/2012; B65D 47/106; B65D 47/103; B65D 47/36; B65D 55/024; B65D 55/02; B65D 2203/02; B65D 2255/06; B65D 2203/00
USPC ..... 222/556, 566–570, 544–545, 222/153.13–153.14, 153.05–153.06
See application file for complete search history.

(56) References Cited

U.S. PATENT DOCUMENTS 3,272,394 A * 9/1966 Sagarin ..... B65D 83/205 222/182
3,516,581 A * 6/1970 Micallef ..... B65D 47/2006 222/529
3,539,078 A * 11/1970 Venus, Jr. ..... B65D 83/205 222/153.07

(Continued)

*Primary Examiner* — Paul R Durand
*Assistant Examiner* — Andrew P Bainbridge
(74) *Attorney, Agent, or Firm* — Wood, Phillips, Katz, Clark & Mortimer

(57) ABSTRACT

A closure (40, 240) for a fluent substance-containing system, such as a container, includes a body (54, 254) for receiving the fluent substance from the system, an actuator (60, 260) assembled with the closure body (54, 254) for selectively preventing or permitting flow of the fluent substance through the closure body (54, 254), and a shell (56, 256) that is mounted around at least a portion of the closure body (54, 254). The shell (56, 256) has a top end (156) and a blocking member (176) having an initial configuration and a separated configuration. In the initial configuration, the blocking member (176) is connected to the top end (156) to prevent the actuator (60, 260) from moving into an open, dispensing position. In the separated configuration, the blocking member (176) is at least partially separated from the top end (156) to allow the actuator (60, 260) to move into the open, dispensing position.

3 Claims, 15 Drawing Sheets

(56) References Cited

U.S. PATENT DOCUMENTS 4,095,725 A * 6/1978 Goncalves ..... B65D 83/205 220/266
D255,550 S * 6/1980 Kirk, Jr. ..... D9/448
4,424,919 A * 1/1984 Knox ..... B05B 11/306 222/153.13
4,424,920 A * 1/1984 Tada ..... B65D 83/205 222/153.07
4,506,808 A * 3/1985 Goncalves ..... B65D 83/205 222/182
4,513,890 A * 4/1985 Goncalves ..... B65D 83/226 222/153.06
4,595,123 A * 6/1986 Libit ..... B65D 47/0895 215/203
4,727,999 A * 3/1988 Gach ..... B65D 47/0885 215/232
4,763,801 A * 8/1988 Nycz ..... B65D 47/305 215/203
4,776,475 A * 10/1988 La Vange ..... B65D 47/305 215/206
5,058,775 A * 10/1991 Gross ..... B65D 47/2006 215/235
5,086,941 A * 2/1992 English ..... B65D 55/024 220/345.2
5,123,561 A * 6/1992 Gross ..... B65D 47/0838 215/237
5,161,706 A * 11/1992 Weinstein ..... B65D 50/041 215/204
5,236,107 A * 8/1993 Spaanstra, Sr. .... B65D 47/2006 215/235
5,314,093 A * 5/1994 Gross ..... B65D 50/067 215/235
5,356,044 A 10/1994 Lavange
5,622,284 A * 4/1997 Sawicki ..... B65D 47/2006 222/153.14
6,283,333 B1 * 9/2001 Knickerbocker .. B65D 47/2006 222/153.14
6,318,595 B1 * 11/2001 Walters ..... B05B 11/3001 222/1
6,405,885 B1 * 6/2002 Elliott ..... B65D 47/0838 215/237
6,478,194 B2 * 11/2002 Haglund ..... B65D 47/26 222/153.14
6,631,820 B2 * 10/2003 Harrold ..... B65D 47/0809 215/230
6,655,553 B2 * 12/2003 Staniszewski ..... B65D 47/0804 215/251
6,691,394 B1 * 2/2004 McClean ..... B65D 47/2006 222/534
7,299,937 B2 * 11/2007 Antier ..... B65D 41/485 215/216
7,303,088 B2 * 12/2007 Sawyer ..... B65D 47/0804 215/237
2002/0166873 A1 * 11/2002 Staniszewski ..... B65D 47/0804 222/153.07
2013/0015157 A1 * 1/2013 Rho ..... B65D 50/041 215/217
2013/0200106 A1 * 8/2013 Kang ..... B65D 55/02 222/153.13
2016/0244215 A1 8/2016 Brem et al.
2019/0092539 A1 * 3/2019 Phillips ..... B65D 47/2006

* cited by examiner

CLOSURE FOR A CONTAINER

TECHNICAL FIELD

The present invention relates generally to a closure for a container or other system that contains a fluent substance.

BACKGROUND OF THE INVENTION AND TECHNICAL PROBLEMS POSED BY THE PRIOR ART

Closures are employed to selectively prevent or permit communication between the exterior and interior of a system through an opening in the system. The system could be a machine, equipment, or container (including bottles and pouches, etc.). A typical closure includes at least (1) a receiving structure (e.g., a body, base, fitment, etc.) located at an opening to the system interior, and (2) a closing element (e.g., a lid, cover, overcap, pivotable disc top type actuator, etc.) that is cooperatively received by the receiving structure.

The receiving structure of the closure can typically be either (1) a separate structure that (a) can be attached at such a system opening, and (b) defines at least one passage through the receiving structure for communicating through such a system opening with the interior of such a system, or (2) an integral structure that is a unitary portion of such a system and that defines at least one passage through the integral structure such that the passage functions as the opening, per se, to the system.

The closing element typically is movable relative to the receiving structure passage between (1) a fully closed position occluding the passage, and (2) an open position at least partially exposing the passage. Some closures may include additional elements such as tamper-evident features, locking elements, etc.

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. If the container is a bottle, pouch, or other such container, then such a container with the closure mounted thereon, and the contents stored in the container, may be characterized as a "package."

One type of dispensing closure is a toggle action type, which typically is provided with a closing element in the form of a generally flat, disc top type actuator or a domed type actuator for dispensing a fluent substance. A user of such a closure will typically encounter the actuator in a closed, non-dispensing position. The actuator may be provided with a region for being pressed upon by a user of the closure to toggle, tilt, pivot, or otherwise rotate the actuator with respect to a stationary portion of the closure (e.g., the closure body), moving the actuator from the closed position into an open position such that a fluent substance may be dispensed through the closure. Such an actuator may subsequently be pressed upon by a user, at a different region of the actuator, to toggle, pivot, or otherwise rotate the actuator back into the closed, non-dispensing position.

The inventors of the present invention have noted that such closures, when installed on a container of a fluent substance, may be susceptible to inadvertent opening during shipping or handling, which can result in premature or messy leaking of the fluent substance stored within the container. For example, the closed actuator may be accidentally bumped open, or the actuator may accidentally open if the inside of the actuator is subjected to a sudden impact from the fluent substance or if the internal pressure of the container increases significantly during shipping or storage in high temperature environments. The inventors have found that such premature leakage through a conventional closure may be especially pronounced in e-commerce, whereby an individual package is shipped and handled in an unconstrained manner and may be subjected to a variety of forces, orientations, and temperatures.

The inadvertent opening of such a closure may be prevented, or at least minimized, by applying an adhesive seal or a film wrap around at least a portion of the closure to mechanically prevent movement of the lid until the seal or wrap has been removed by a user of the closure. Such additional adhesive seals and film wraps are typically designed and provided for only a "one-time" use (non-reusable) application to withstand lid opening forces during shipping and may increase the cost of the closure, require additional manufacturing steps, or present a nuisance to the user who must remove and discard such a seal.

Furthermore, the inventors have found that the inadvertent opening of such a closure may be prevented, or at least minimized, by modifying the existing closing means (e.g., latching or snap-fit connections) of conventional closures to increase the force required to open such closing means. Such modifications may also present a nuisance to the user of the closure because the user must generate a sufficient force to open such a strengthened closing means, and may be injured in the attempt, or may even be unable to open such a strengthened latch or connection altogether.

The inventors of the present invention have determined that it would be desirable to provide a component of the closure that may be separately formed from the closure body and actuator, but which is assembled with the closure body and actuator for preventing inadvertent opening of the closure during shipping or handling. The inventors of the present invention have further found that it would be desirable to provide indicia on such a separately formed component of the closure in a manner that would be amenable to mass production and customization for multiple applications or customers.

The inventors of the present invention have further determined that it would be beneficial to provide such a component separately formed from the closure body and actuator, but which is assembled with the closure body and actuator in only a single orientation to facilitate efficient assembly of the closure components.

The inventors of the present invention have further determined that it would be beneficial to provide such an improved closure that would facilitate easy opening or actuation by a user.

The inventors of the present invention have also determined that it would be desirable to provide such an improved closure that can be configured for use with a container of a fluent substance so as to have a reduced cost of manufacture and/or assembly.

The inventors of the present invention have invented a novel structure for a closure for use with a system, which could be a container or other type of system, wherein the closure includes various advantageous features not heretofore taught or contemplated by the prior art.

BRIEF SUMMARY OF THE INVENTION

According to broad aspects of one form of the present invention, a closure is provided for a system having an opening between an exterior of the system and an interior of the system where a fluent substance may be stored. The closure has a closure body that can be located at the system opening and that defines a through passage for communicating with the system to accommodate the flow of a fluent substance through the closure body.

The closure further includes an actuator that is rotatably mounted to the closure body for occluding the through passage of the closure body to prevent flow of a fluent substance through the closure when the actuator is in a closed, non-dispensing position. The actuator permits flow of a fluent substance through the closure when the actuator is rotated to an open, dispensing position.

The closure includes a shell that is mounted around at least a portion of the closure body. The shell has a top end and a blocking member having an initial configuration and a separated configuration. In the initial configuration, the blocking member is connected to the top end to prevent the actuator from moving into the open, dispensing position. In the separated configuration, the blocking member is at least partially separated from the top end to allow the actuator to move into the open, dispensing position.

In one aspect of the present invention, the closure body is adapted for use with a system that is a container defining the opening and the closure body is one of: a separate structure for being attached to the container at the container opening; and an integral structure that is a unitary part of a container formed at the container opening.

In another aspect of the present invention, the blocking member is frangibly connected to the top end of the shell by at least one frangible connection in the initial configuration.

In another aspect of the present invention, the blocking member is frangibly connected to the top end of the shell by a plurality of frangible connections in the initial configuration, and the frangible connections are sized and arranged to break when an axially upward force is exerted on the blocking member of between about eight Newtons and about forty-five Newtons.

In still another aspect of the present invention, the blocking member extends axially outwardly of the top end of the shell in the initial configuration.

According to another form of the present invention, the blocking member defines an interior surface and the actuator has a top end. The blocking member interior surface is spaced from the actuator top end between about 0.2 mm and about 0.6 mm with the blocking member in the initial configuration.

In another form of the invention, the blocking member defines a projection extending laterally from a portion of the blocking member. The actuator further has a top end defining a sloping back region. In the initial configuration of the blocking member, the projection of the blocking member extends laterally over the sloping back region of the actuator.

According to another aspect of the present invention, the blocking member defines a generally arcuate perimeter portion that is frangibly connected to the top end of the shell by a plurality of frangible connections in the initial configuration of the blocking member. The blocking member further defines a projection extending laterally from a substantially flat portion of the blocking member.

In another aspect of the present invention, one of the closure body and the shell has a rib, and the other of the closure body and the shell has a slot. With the shell mounted on the closure body, the rib is received within the slot to assist in assembly of the closure body together with the shell and to prevent relative rotation between the closure body and the shell. In still another aspect of the present invention, the rib has a tapered upper portion.

According to another form of the invention, the closure body has a pair of diametrically-spaced ribs extending therefrom, and the shell has an outer wall defining a pair of diametrically-spaced slots such that each one of the slots of the shell receives one of the ribs of the closure body.

In still another form of the invention, each of the closure body and the shell has at least one snap-fit bead for cooperative engagement to secure the closure body together with the shell.

In one aspect of the invention, the closure body and the shell are coupled at a lower end of the closure body to define a tamper-evident assembly.

In another aspect of the invention, the blocking member defines a laterally-extending projection and the shell has a generally cylindrical outer wall with a finger recess formed therein. The projection of the blocking member extends laterally outwardly toward the finger recess when the blocking member is in the initial configuration.

In still another aspect of the invention, the blocking member has an exterior surface defining at least one indicium.

According to another form of the invention, the blocking member has a concave interior surface facing the actuator with the blocking member in the initial configuration, and with the shell mounted atop the closure body and the actuator.

According to yet another form of the invention, each of the closure body, the actuator, and the shell are separately molded.

According to another form of the present invention, the closure is provided in combination with a system that is a container of a fluent substance. The closure, the container, and the fluent substance together define a package.

In still another form of the invention, the closure body is provided with a pair of diametrically-spaced ribs and a pair of diametrically-spaced snap-fit beads extending between the ribs. The shell is provided with a pair of diametrically-spaced slots and a pair of diametrically-spaced snap-fit beads extending between the slots.

It should be appreciated that the invention may include any or all of the above-described aspects, include only one of the above aspects, more than one of the above aspects, and any combination of the above aspects. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 2 shows the "rear" region of the closure (i.e., the view in FIG. 2 is taken about 180 degrees from the view in FIG. 1);

DESCRIPTION OF THE PREFERRED EMBODIMENTS

Figure 1:
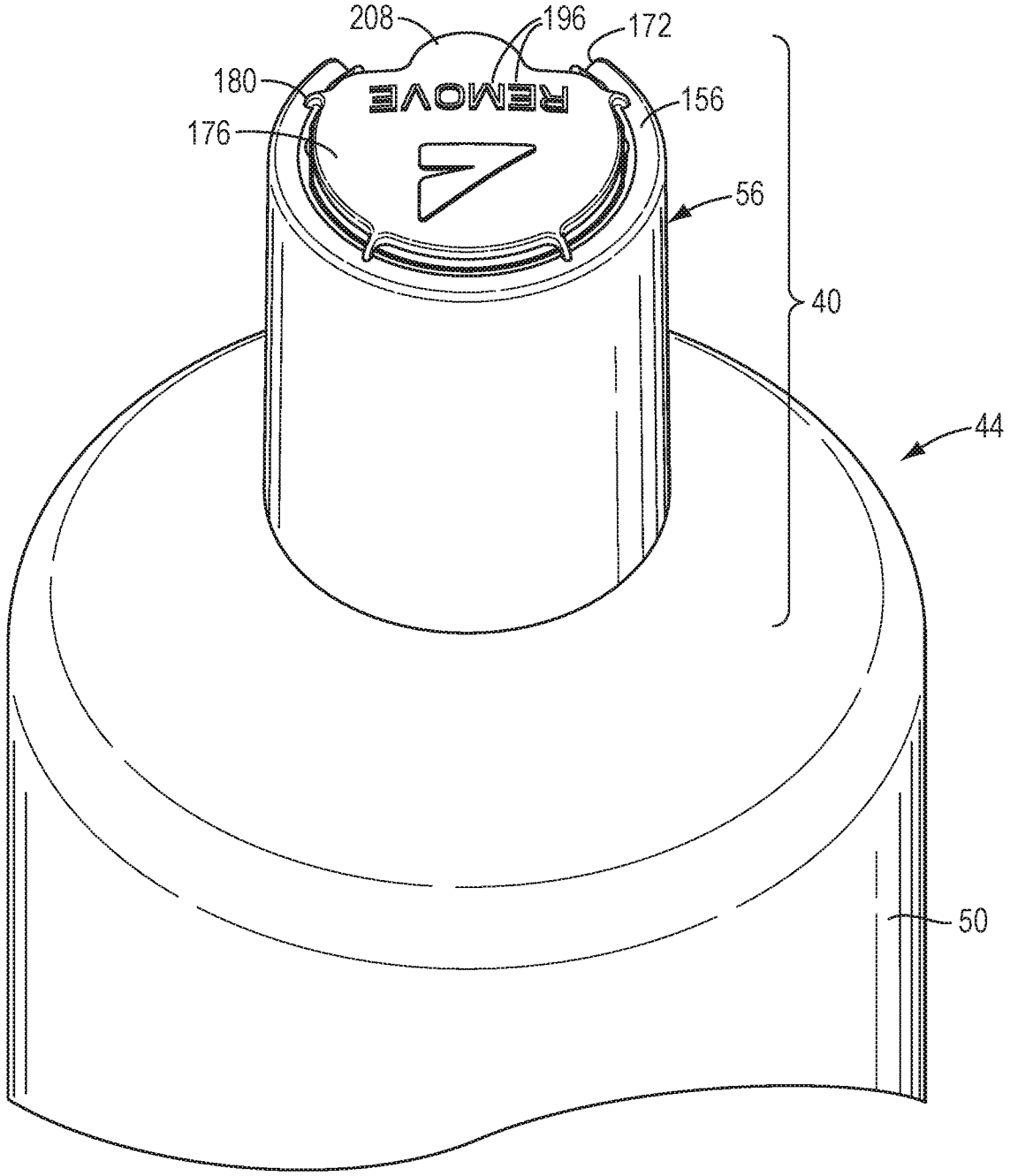
FIG. 1 is a perspective view, taken from above, of a first embodiment of a closure of the present invention shown installed at the opening of a container wherein only a fragmentary, upper portion of the container is illustrated in FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the inventive closure show an embodiment in the typical orientation that the closure would have at the opening of a system that is a container in the form of an upright bottle, and terms such as "inward", "outward", "upper", "lower", "axial", "radial", "lateral", etc., are used with reference to this orientation. The terms "axial" and "radial" are used with respect to a central axis 20 (FIG. 11), generally defined as the central longitudinal axis of the closure. The phrase "axially inwardly" refers to the direction along the central axis 20 toward the bottom of the closure and toward the container interior as viewed in the relevant figures. The phrase "axially outwardly" refers to the opposite direction along the central axis 20 toward the top of the closure and away from the container interior. It will be understood, however, that the closure of this invention may be manufactured, stored, transported, used, and sold in an orientation other than the orientation described.

The closure of this invention is especially suitable for use with, among other things, a variety of conventional or special systems, including containers, the details of which, although not fully illustrated or described, would be apparent to those having skill in the art and an understanding of such containers. The particular container, per se, that is illustrated and described herein forms no part of, and therefore is not intended to limit, the present invention. It will also be understood by those of ordinary skill that novel and non-obvious inventive aspects are embodied in the described exemplary closures alone.

The illustrated closures and the modifications thereof described herein are especially suitable for use on a container that contains a fluent material or substance in the form of a lotion or cream that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, manufacturing, commercial or household maintenance, construction, agriculture, etc.).

A first embodiment of a closure of the present invention, and the components thereof, are illustrated in FIGS. 1-17, wherein the closure is designated generally by the reference number 40. In the illustrated first embodiment, the closure 40 is provided in the form of a separate article which is configured to be attached or assembled to a system such as a container 44 that would typically contain a fluent substance.

The container 44 may be any conventional type, such as a collapsible, flexible pouch, or may be a generally rigid container that has somewhat flexible, resilient walls, such as a bottle or tank. FIG. 1 shows a first embodiment of the closure 40 attached to a container 44 that is a generally rigid bottle having a wall that is somewhat flexible and that can be squeezed by the user to dispense a product when the closure 40 is opened (typically while the user is also inverting the container 44 and the closure 40). The closure 40 may instead be used on a larger dispensing system (not illustrated) which may include, or be part of, for example, a medical device, processing machine, dispenser, reservoir on a machine, etc., wherein the system has an opening to the system interior.

The container 44, or a portion thereof, may be made from a material suitable for the intended application (e.g., a thin, flexible material for a pouch (wherein such a material could be a polyethylene terephthalate (PET) film or a polyethylene film and/or an aluminum foil), or a thicker, less flexible material such as molded polyethylene or polypropylene for a more rigid container such as a bottle).

In applications wherein the closure 40 is mounted to a container 44 such as a bottle or pouch (not illustrated), it is contemplated that typically, after the closure manufacturer would make the closure 40 (e.g., by molding parts of the closure 40 from a thermoplastic polymer and assembling them), the closure manufacturer will then ship the closure 40 to a container filler facility at another location where the container 44 is either manufactured or otherwise provided, and where the container 44 is filled with a product prior to installation of the closure 40. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the illustrated first embodiment of the closure 40, the closure 40 is provided as a separately manufactured article, component, or unit for being screwed onto the container 44. It will be appreciated, however, that in some applications, it may be desirable for the closure 40 to be attached to a container 44 in a manner that would not allow a user to easily remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

The illustrated first embodiment of the closure 40, if initially formed separately from the container 44, is adapted to be attached to the container 44 at an opening in the container which provides access to the container interior and to the fluent contents contained therein after a portion of the closure 40 is opened as described hereinafter.

The container 44, per se, such as a bottle, pouch, or other container, per se, does not form a part of the broadest aspects of the present invention. The container 44, or other system, may have any suitable configuration.

Figure 11:
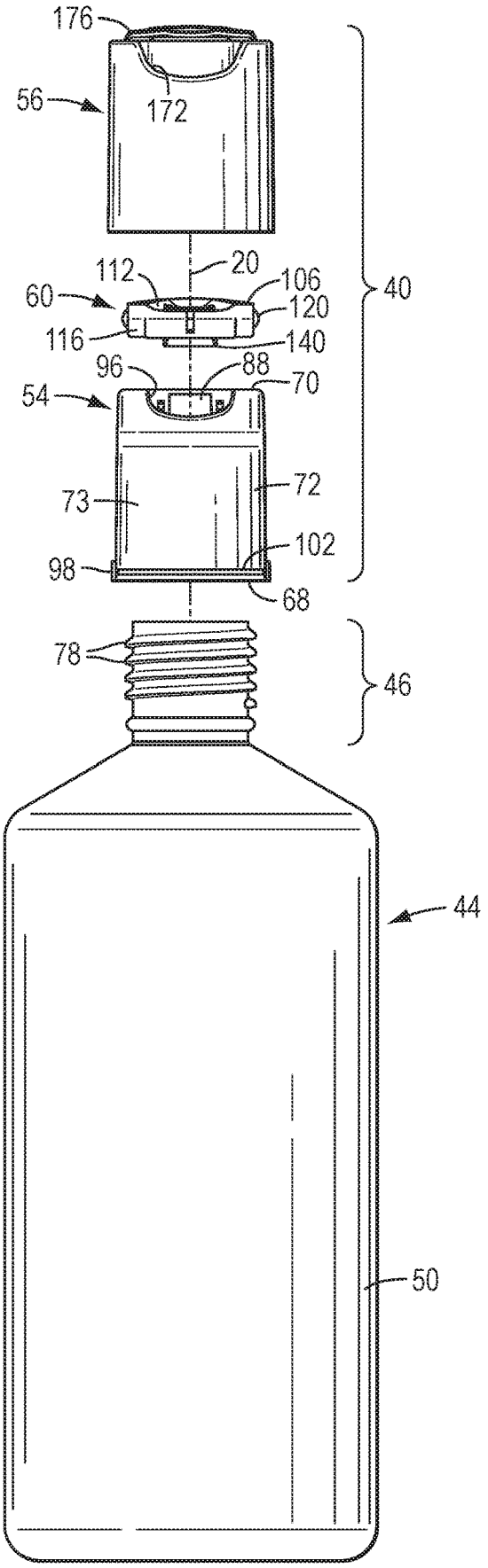
FIG. 11 is an exploded, rear elevation view of the components of the closure and the container illustrated in FIG. 1.
Figure 12:
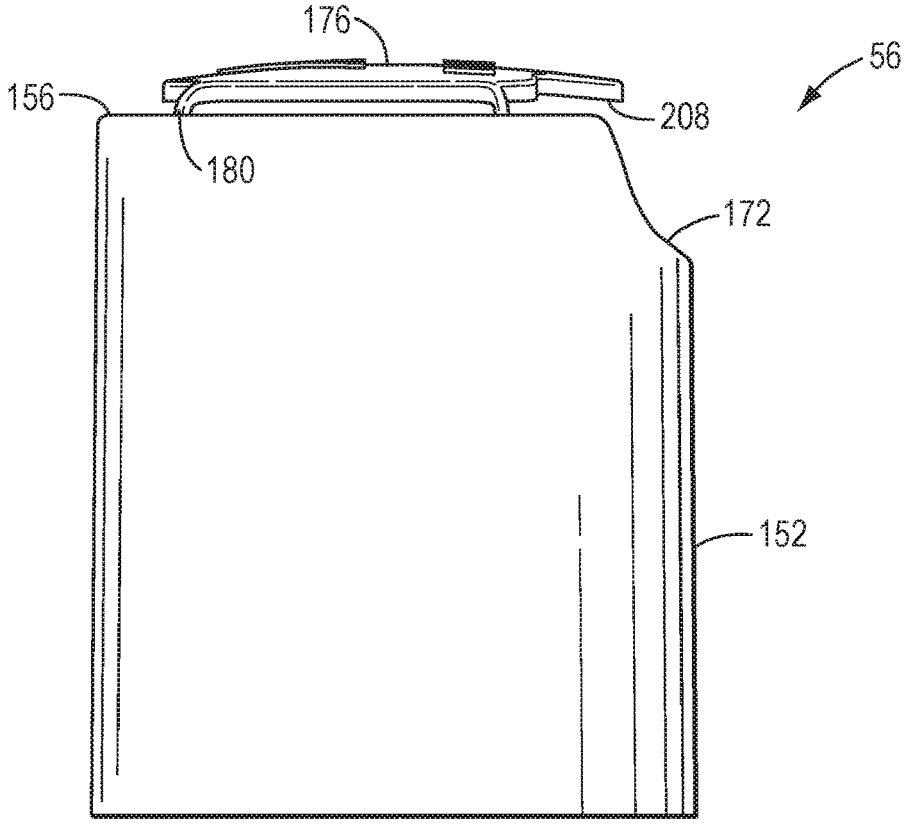
FIG. 12 is a right side elevation view of only the shell component of the closure shown in FIG. 1.
Figure 13:
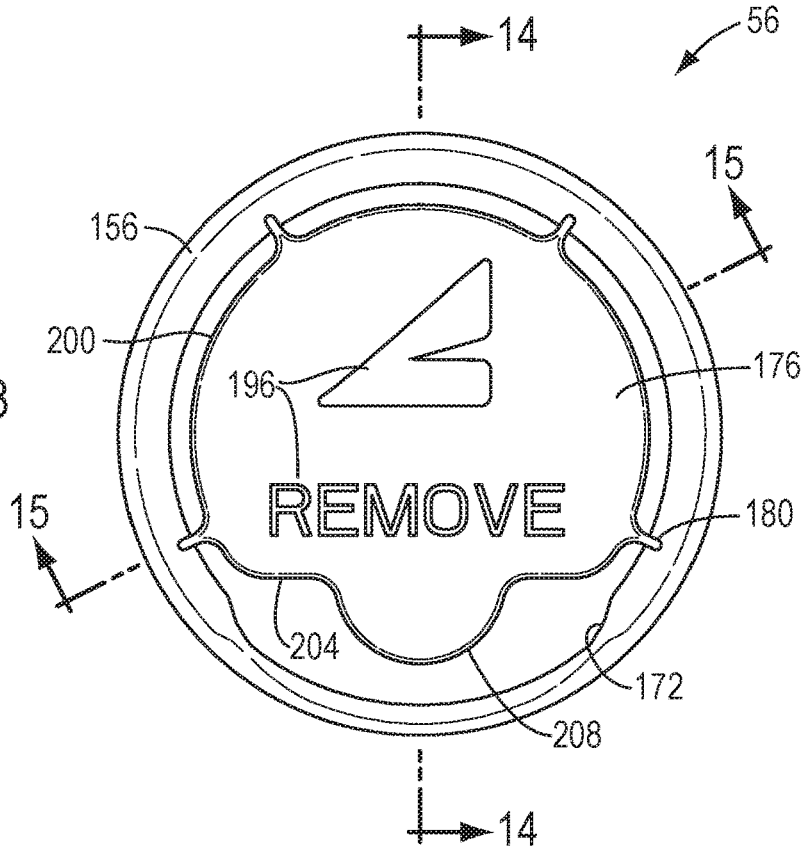
FIG. 13 is a top plan view of the shell shown in FIG. 12.

With reference to FIG. 11, where the illustrated container 44 is a bottle, the bottle typically includes an upper end portion 46 (or other suitable structure on some part of the bottle) that defines the bottle mouth or opening and a threaded portion (or snap-fit bead, not illustrated) for mating with a cooperating threaded portion (or snap-fit bead, not illustrated) of the closure 40, which is discussed in detail hereinafter. The bottle upper end portion 46 typically has a cross-sectional configuration with which the closure 40 is adapted to engage. Extending from the upper end portion 46 is a main body portion 50 of the bottle. The main body portion 50 has a cross-sectional configuration that differs from the cross-sectional configuration of the bottle upper end portion 46 at the bottle opening. In other types of bottles, the bottle may instead have a substantially uniform shape along its entire length or height without any portion having a different size or different cross-section.

The first embodiment of the closure 40 illustrated in the FIGS. 1-17 is especially suitable for use with a container 44 that is a bottle having a substantially flexible wall or walls that can be squeezed or deflected laterally inwardly by the user to increase the internal pressure within the bottle to force the fluent substance out of the bottle and through the opened closure 40. The walls have sufficient, inherent resiliency so that when the squeezing forces are removed, the bottle walls return to the normal, unstressed shape.

In other applications, it may be desirable to employ a generally rigid container, and to pressurize the container interior at selected times with a piston or other pressurizing system (not illustrated), or to reduce the exterior ambient pressure to suck the material out through the open closure.

In some other applications, the closure 40 may be used with a product containment system or other type of system (not illustrated) where the closure 40 can function to permit or prevent the egress or ingress of substances relative to the system in which the closure 40 is installed.

For example, in some applications it may be desirable to also accommodate filling or refilling of the container 44 with the fluent contents through the opened closure 40 into the container 44.

With reference to FIG. 11, the closure 40 includes the following basic components: a base or closure body 54, a sheath or shell 56, and an actuator 60. An optional cap, overcap, or lid (not illustrated) could be provided for being removably mounted atop of the closure 40. The closure body 54, the shell 56, and the actuator 60 are preferably formed or molded as separate structures and subsequently assembled together. The closure body 54, the shell 56, and the actuator 60 are each preferably molded from a suitable thermoplastic material such as polyethylene or polypropylene. Other materials may be employed instead. It will be understood that in alternative designs (not illustrated), two or more of the three basic components may be unitarily formed or molded together initially as one connected structure, and then substantially broken apart, and then assembled in an operative combination. Further, it will be understood that the closure body 54 may be unitarily formed or molded as an extension of the upper end portion 46 of the container 44.

The actuator 60 is movable between a closed position (FIG. 8) and an open, dispensing position (FIGS. 9 and 10) relative to the closure body 54. The detailed operation and construction of similar actuators are disclosed in U.S. Pat. Nos. 4,962,869 and 6,832,700, which are incorporated by reference herein in their entireties. A removable or separable portion of the shell 56 (FIGS. 1-3), discussed in detail below, initially prevents or blocks the actuator 60 from moving from the closed position into the open position. Removal of this portion of the shell 56 by a user of the closure 40 (FIG. 8) permits the actuator 60 to be moved from the closed position into the open position by a user of the closure 40.

Figure 6:
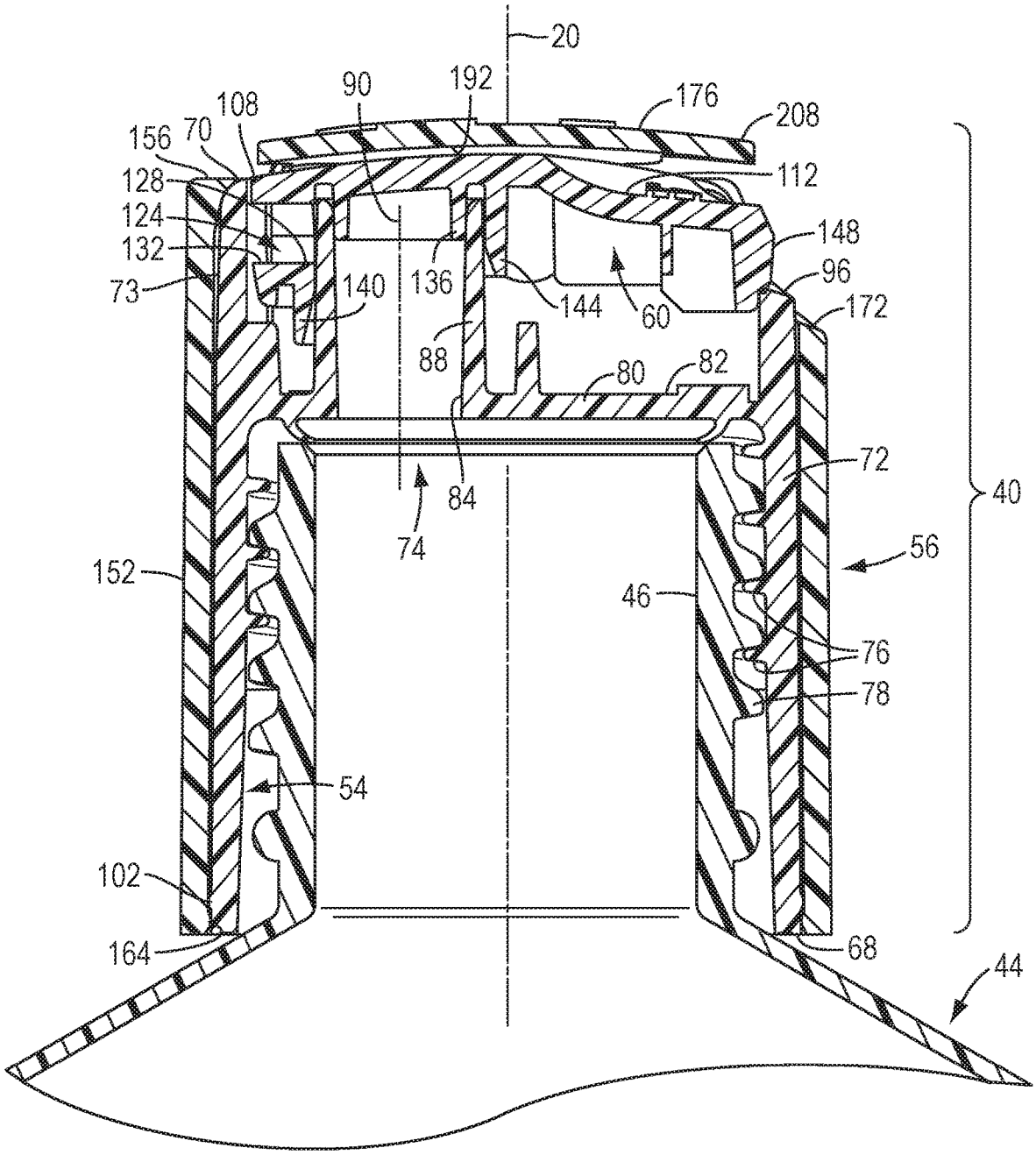
FIG. 6 is an enlarged, fragmentary, cross-sectional view of the closure and container illustrated in FIG. 1, taken generally along the plane 6-6 in FIG. 3.
Figure 7:
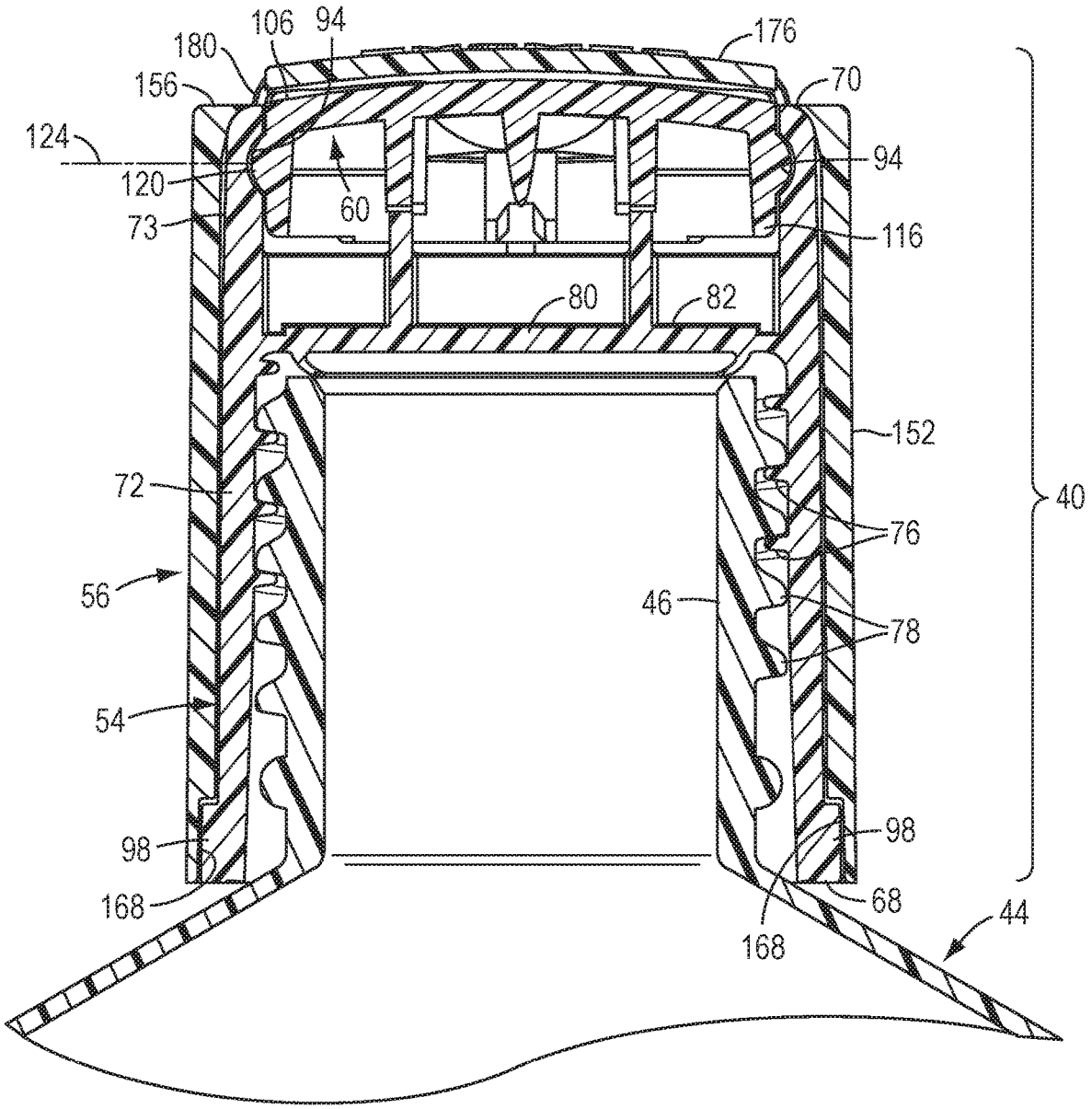
FIG. 7 is an enlarged, fragmentary, cross-sectional view of the closure and container illustrated in FIG. 1, taken generally along the plane 7-7 in FIG. 3.

Referring now to FIGS. 6, 7, and 11, the closure body 54 includes an inlet portion or lower end 68 and an upper end 70. A cylindrical skirt or wall 72 extends between the lower end 68 and the upper end 70, and defines an exterior surface 73. The interior surface of the wall 72 defines an inlet passage 74 (FIG. 6 only) for being located at the opening of the bottle 44 to communicate with an interior of the bottle 44 containing a fluent substance.

Referring only to FIGS. 6 and 7, the interior of the closure body 54 is provided with a plurality of internal threads 76 extending radially inwardly therefrom. The internal threads 76 cooperate with, and threadingly engage, mating external threads 78 on the container 44 to securely attach the closure body 54 together with the container 44 at the opening of the container 44. It will be appreciated that other conventional or special means of connecting the closure body 54 to the container 44 could be employed, such as mating snap-fit beads, mating grooves and snap-fit beads, bi-injection molding, adhesives, mechanical locks, spin welding of the closure to the container, etc.

If the closure body 54 is to be used on a flexible pouch (not illustrated), then it is presently contemplated that the closure body lower end would have a suitable boat-shaped or diamond-like fitment configuration (e.g., such as that shown in international patent application publication number WO/2014/193358, which is incorporated by reference herein in its entirety) for being sealed with the pouch, and most pouch manufacturers will prefer to install the closure body lower end at an opening formed in the pouch with heat sealing techniques or ultrasonic sealing techniques.

Referring now particularly to FIG. 6, the closure body wall 72 includes a recessed deck 80 extending laterally across the interior of the closure body 54. The recessed deck 80 has an upper surface 82 and further defines a circular aperture 84 extending through the recessed deck 80. A cylindrical spout 88 extends upwardly from the recessed deck 80 and surrounds the aperture 84. The spout 88, via the aperture 84, opens to (i.e., communicates with) the inlet passage 74 of the closure body 54. The spout 88 is centered on a secondary axis 90 that is offset from the central axis 20 of the closure 40. As will be discussed in detail hereinafter, the fluent substance stored within the container 44 flows from the outlet end of the container 44, within the inlet passage 74 of the closure body 54, and into the spout 88.

As best shown in FIG. 7, the inside of the wall 72 of the closure body 54 is provided with a pair of opposing detents or hemispherical recesses 94 that serve to retain mating hemispherical protrusions or trunnions formed on oppositely-facing sides of the actuator 60, as discussed in detail below. The wall 72 is further provided with a recessed region or finger recess 96 (FIGS. 16 and 17) at the top end 70 of the closure body 54. The finger recess 96 accommodates downward movement of a user's finger during the actuation of the actuator 60 relative to the closure body 54.

Figure 16:
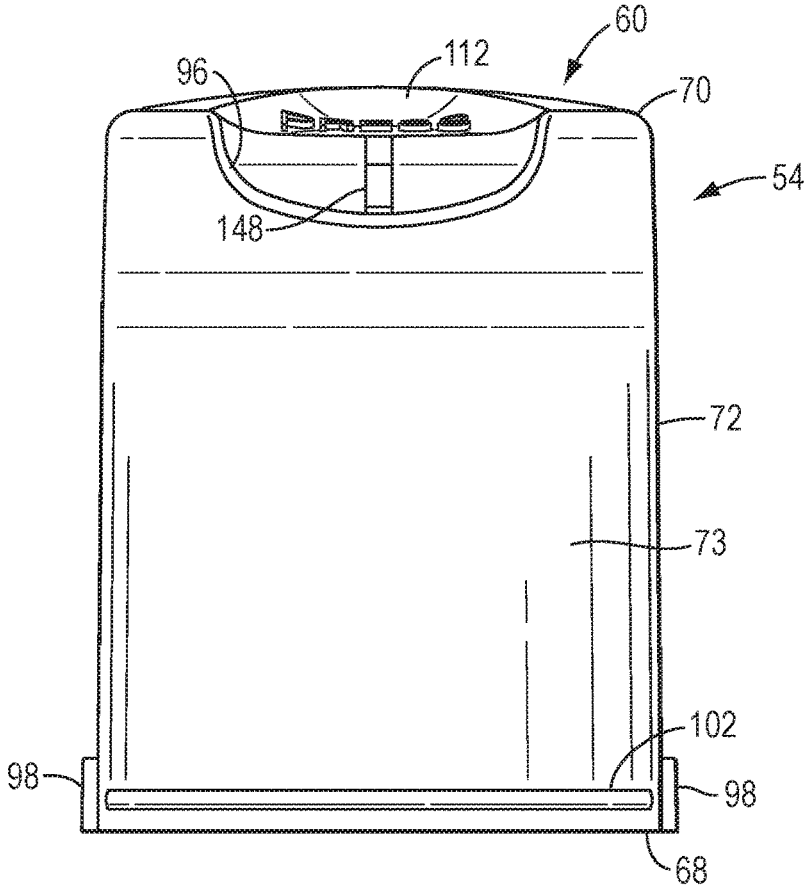
FIG. 16 is a rear elevation view of only the subassembly of the closure body and actuator components of the closure shown in FIG. 1.
Figure 17:
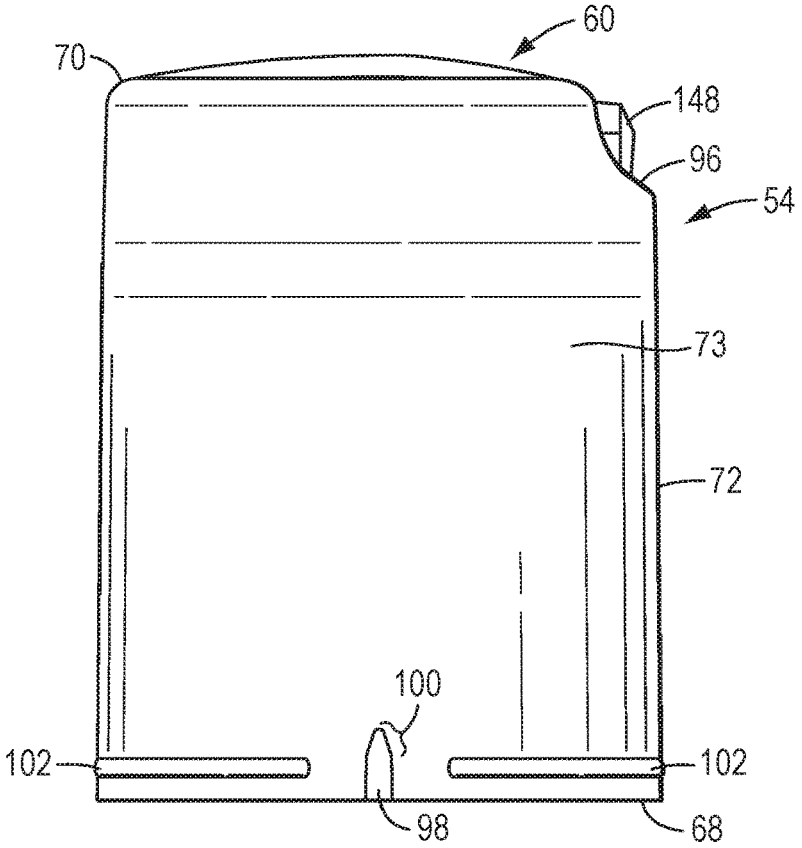
FIG. 17 is a right side elevation view of only the subassembly of the closure body and actuator components of the closure shown in FIG. 16.

Referring now to FIGS. 16 and 17, the exterior surface 73 of the wall 72 is provided with a pair of alignment projections or ribs 98 that are diametrically-spaced on opposite sides of the exterior surface 73, at the lower end 68 of the closure body 54. The upper portion or tip 100 of each rib 98 is tapered, and the ribs 98 are configured and arranged to be received within a pair of diametrically-spaced slots within opposite sides of the shell 60, which will be discussed in detail below.

Still referring to FIGS. 16 and 17, the lower end of the exterior surface 73 of the closure body wall 72 has a pair of circumferentially-extending snap-fit beads 102 arranged on opposite sides of the exterior surface 73. Each bead 102 is located between the two ribs 98, and together mate with beads on the shell 60 to retain the shell 60 on the closure body 54 as described hereinafter. The beads 102 are spaced axially outwardly from the lower end 68 of the closure body 54.

While the closure body 54 is illustrated as having a generally cylindrical structure, it will be appreciated, however, that the closure body 54 may take a variety of forms, and need not be limited to a cylindrical shape and need not have a generally circular cross-section (taken in a horizontal plane that is perpendicular to the central axis 20). For example, the lower end 68 and/or the upper end 70, and the wall 72 therebetween, may be elliptical, polygonal, or some irregular shape.

Figure 8:
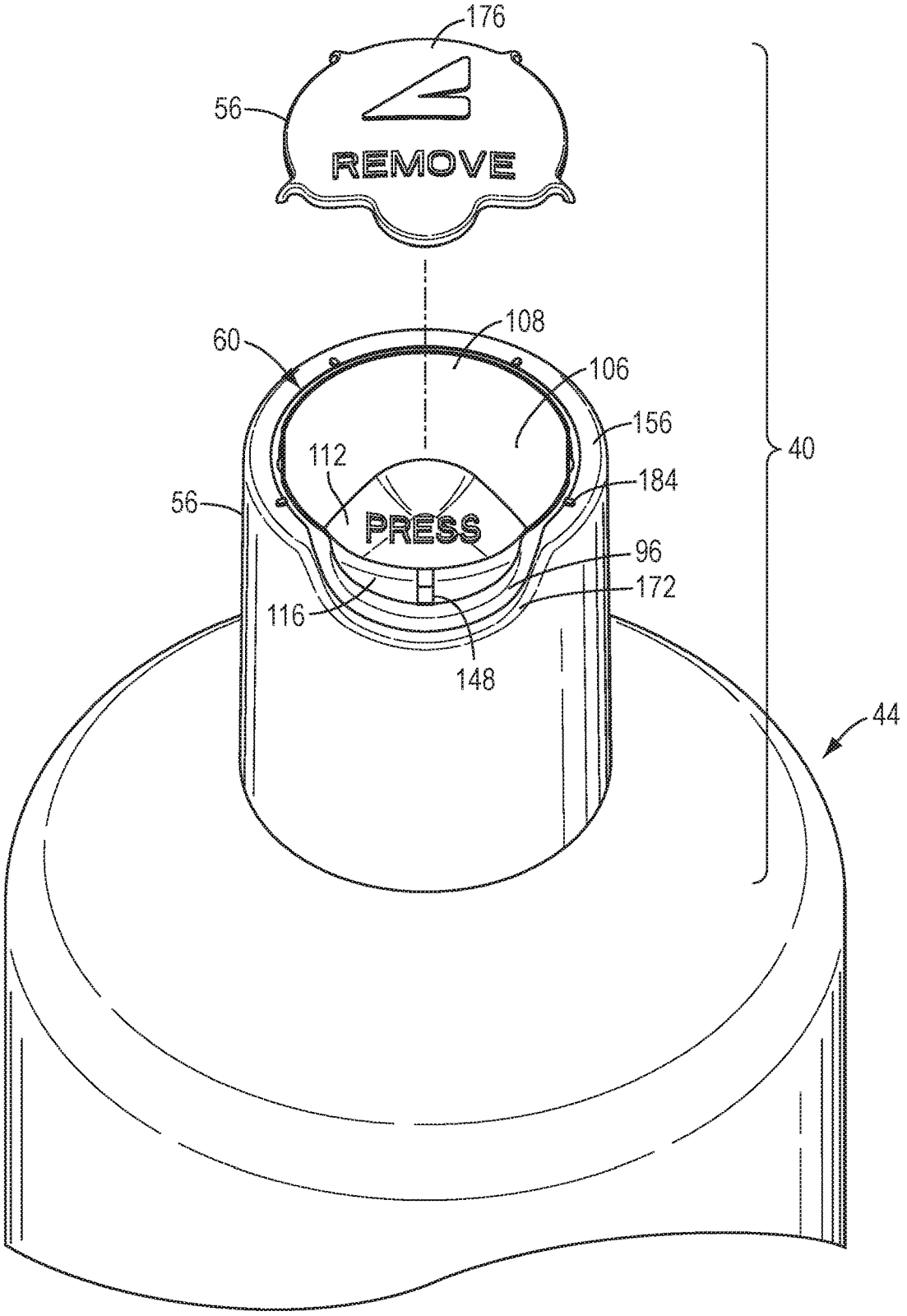
FIG. 8 is a perspective view of the closure and container similar to the view of the rear region of the closure shown in FIG. 2, however in FIG. 8 a blocking member of the closure has been separated away from the remainder of the closure.
Figure 9:
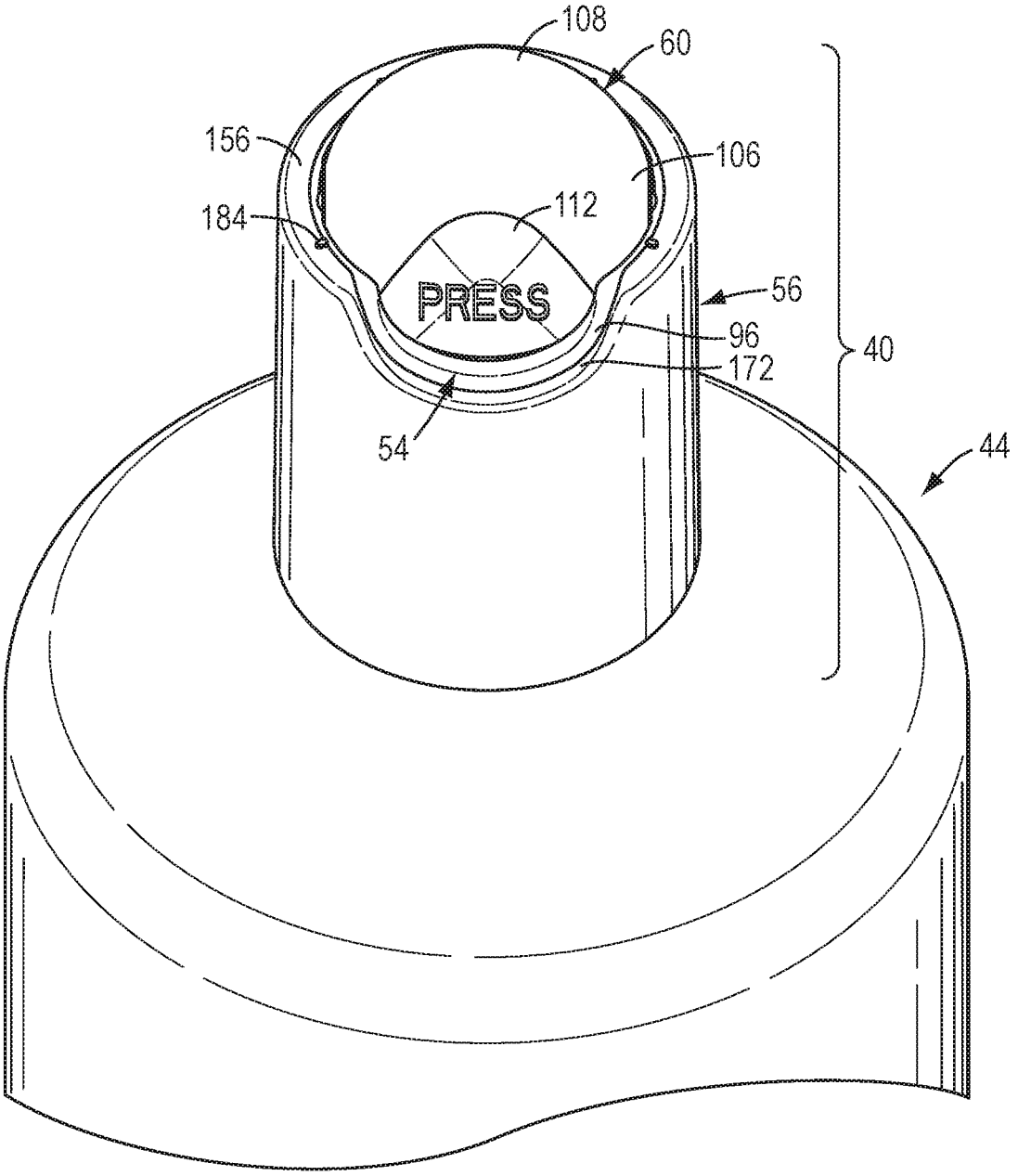
FIG. 9 is a perspective view of the closure and container similar to the view of the rear region of the closure shown in FIG. 8, however in FIG. 9 the actuator of the closure is has been pivoted from a closed position into an open, dispensing position.

As shown in FIGS. 8, 9, and 11, the actuator 60 has a generally disc-like shape with a generally flat top end 106 with a front region 108 and a recessed, concave, or sloping back region 112 designed to accommodate the finger of a user of the closure 40 during opening of the actuator 60. With reference to FIGS. 7 and 11, the actuator 60 has an annular side wall 116 with a pair of hemispherical protrusions or trunnions 120 extending therefrom, and spaced 180 degrees apart from one another. Each one of the protrusions 120 fits within one of the hemispherical recesses 94 (FIG. 7 only) within the closure body 54. The protrusions 120 rotate about a pivot axis 124 (FIG. 7) within the recesses 94, allowing the entire actuator 60 to pivot or rotate with respect to the closure body 54, the operation of which is discussed hereinafter.

Figure 10:
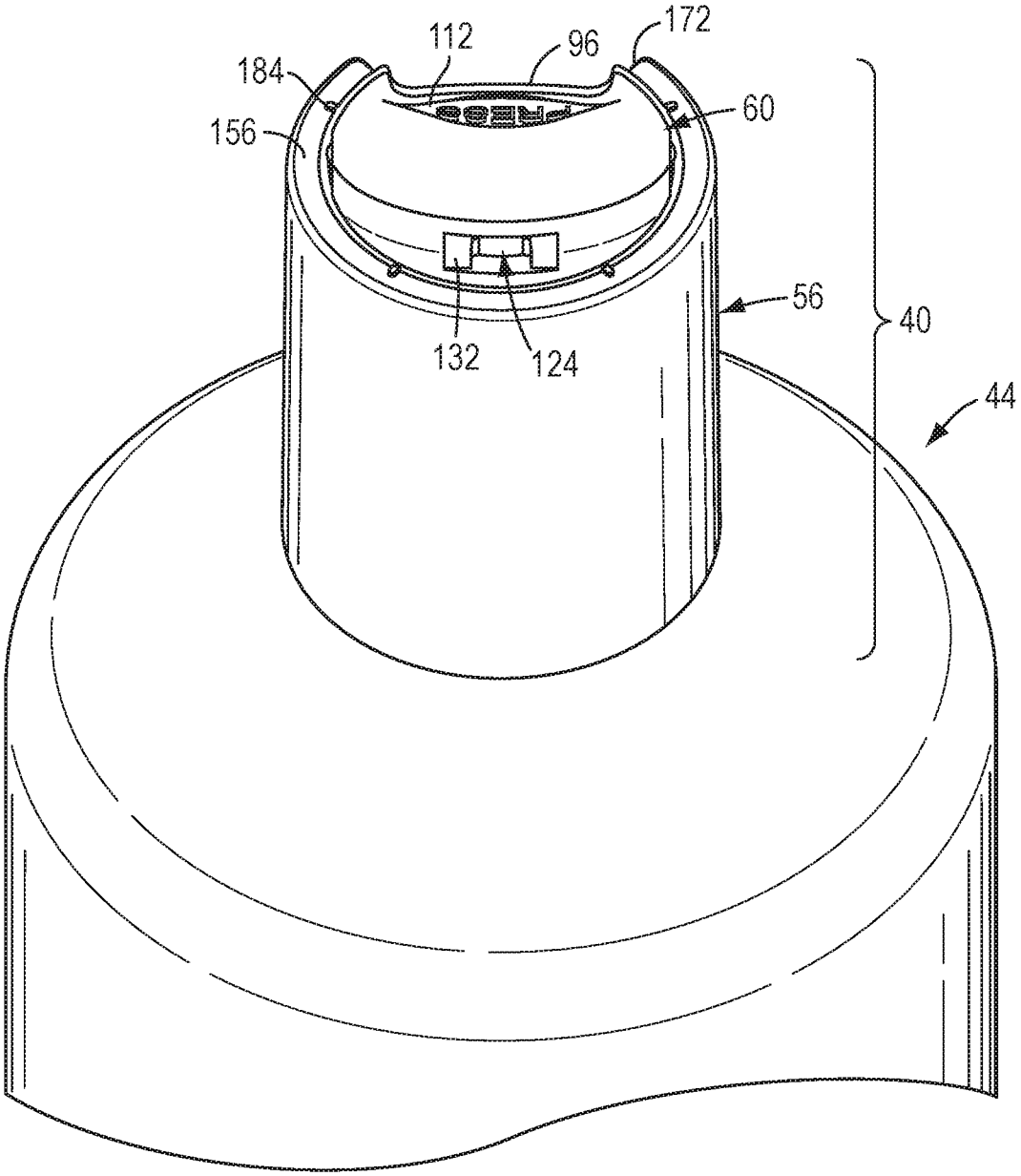
FIG. 10 is a perspective view of the "open" closure and container shown in FIG. 9, however the view in FIG. 10 is taken about 180 degrees from the view in FIG. 9 to show the blocking member of the closure separated away from the remainder of the closure and to show the actuator of the closure pivoted from a closed position into an open, dispensing position.

As illustrated in FIGS. 6 and 10, the actuator 60 is provided with a dispensing flow passage 124 having an inlet end 128 (FIG. 6 only) and an outlet end 132 on the exterior of the actuator 60. The dispensing flow passage 124 may be selectively placed into communication with the spout 88 (FIG. 6 only) of the closure body 54 (FIG. 6 only) when the actuator 60 is pivoted from a closed position (FIG. 6) to an open position (FIG. 10) by a user of the closure 40.

As illustrated in FIG. 6, the actuator 60 has a cylindrical plug or internal annular wall 136 that extends downwardly therefrom to seal against the inside of the spout 88 when the actuator 60 is in the closed position. A first semi-circular sealing rim 140 and a second semi-circular sealing rim 144 extend downwardly from the actuator 60 to maintain a fluid tight seal between the closure body 54 and the actuator 60 in the open position (FIG. 10), such that the outlet end 132 of the dispensing flow passage 124 is the only path of egress for a fluent substance when the actuator 60 is in the open position. The configuration and operation of such a flow passage and sealing rims is illustrated and described in detail in the aforementioned U.S. Pat. Nos. 4,962,869 and 6,832,700.

With reference now to FIGS. 6, 16, and 17, the annular side wall 116 of the actuator 60 has a wedge-shaped projection or cam element 148 extending therefrom. The cam element 148 is located at the back (i.e., rear) end of the actuator 60 adjacent the sloping back region 112 of the actuator 60 and functions to frictionally engage the inside of the annular wall 72 of the closure body 54 (FIG. 6). The frictional engagement of the cam element 148 with the closure body 54 stabilizes the actuator 60 to maintain the actuator 60 in both the open and closed positions with respect to the closure body 54 after the user has pivoted the actuator 60 to the desired open or closed position. A slight deflection of the closure components may accommodate the frictional engagement.

As shown in FIGS. 6 and 7, the shell 56 is assembled around and overtop of the closure body 54 to initially prevent a user of the closure 40 from moving the actuator 60 from the closed position into the open, dispensing position. The shell 56 is hollow with a generally cylindrical shape, and includes an annular wall 152 that slides over the annular wall 72 of the closure body 54.

Figure 14:
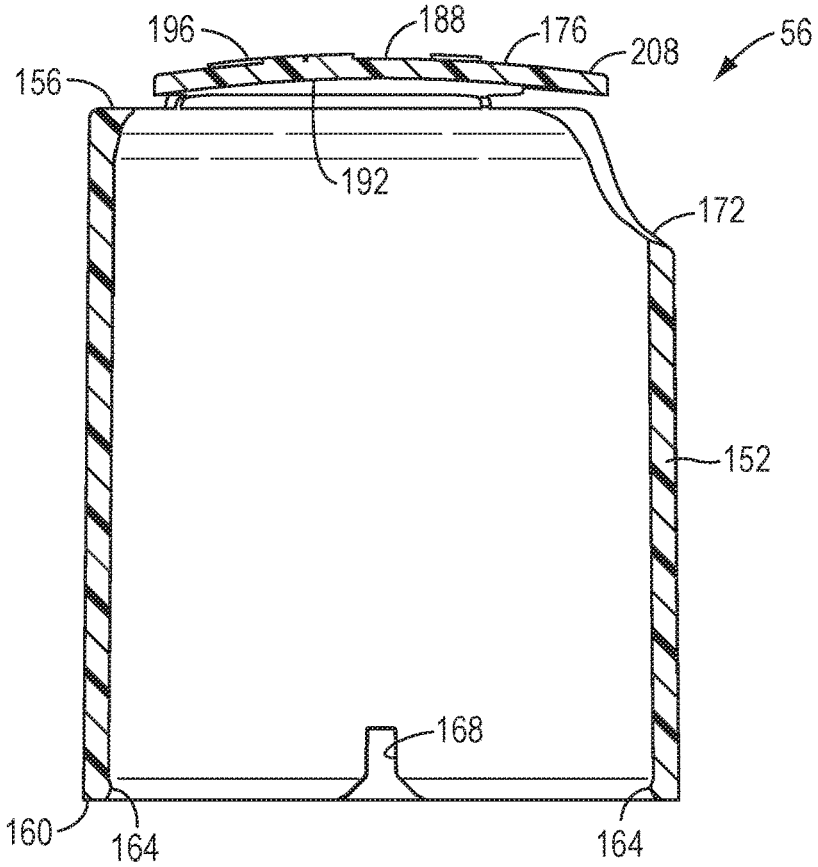
FIG. 14 is a cross-sectional view of the shell illustrated in FIG. 12, taken generally along the plane 14-14 in FIG. 13.

With reference to FIG. 14, the shell annular wall 152 includes a top end 156 and a bottom end 160. A pair of annular snap-fit beads 164 extend laterally inwardly from the inside surface of the annular wall 152. Each of the snap-fit beads 164 engages and slides over one of the two snap-fit beads 102 on the exterior surface 73 of the closure body 54 (see FIG. 6), thus retaining the shell 56 atop of the closure body 54. The design of the snap-fit engagement of the shell 56 with the closure body 54 could be adjusted such that the two components of the closure 40 are removable by a user or nonremovable by a user. Specifically, the force required by a user of the closure 20 to overcome the frictional engagement of the beads 102, 164 might be increased or decreased depending on the size, shape, number, and/or location of the beads 102, 164. Furthermore, the connection of the shell 56 and the closure body 54 might serve a tamper-evident purpose, with one or both of the components of the closure 40 exhibiting stress-whitening or fracture if forced apart by a user subsequent to initial assembly by a closure manufacturer.

With reference now to FIGS. 7 and 14, the bottom end 160 of the annular wall 152 includes a pair of oppositely-facing slots 168 therein. Each one of the slots 168 receives one of the ribs 98 (FIG. 7 only) that extend from the exterior surface 73 (FIG. 7 only) of the closure body 54 (FIG. 7 only). As discussed hereinafter, the ribs 98 assist in the assembly of the shell 56 over the closure body 54 in a pre-selected orientation (FIGS. 1-10) and prevent the relative rotation between the shell 56 and the closure body 54.

Figure 2:
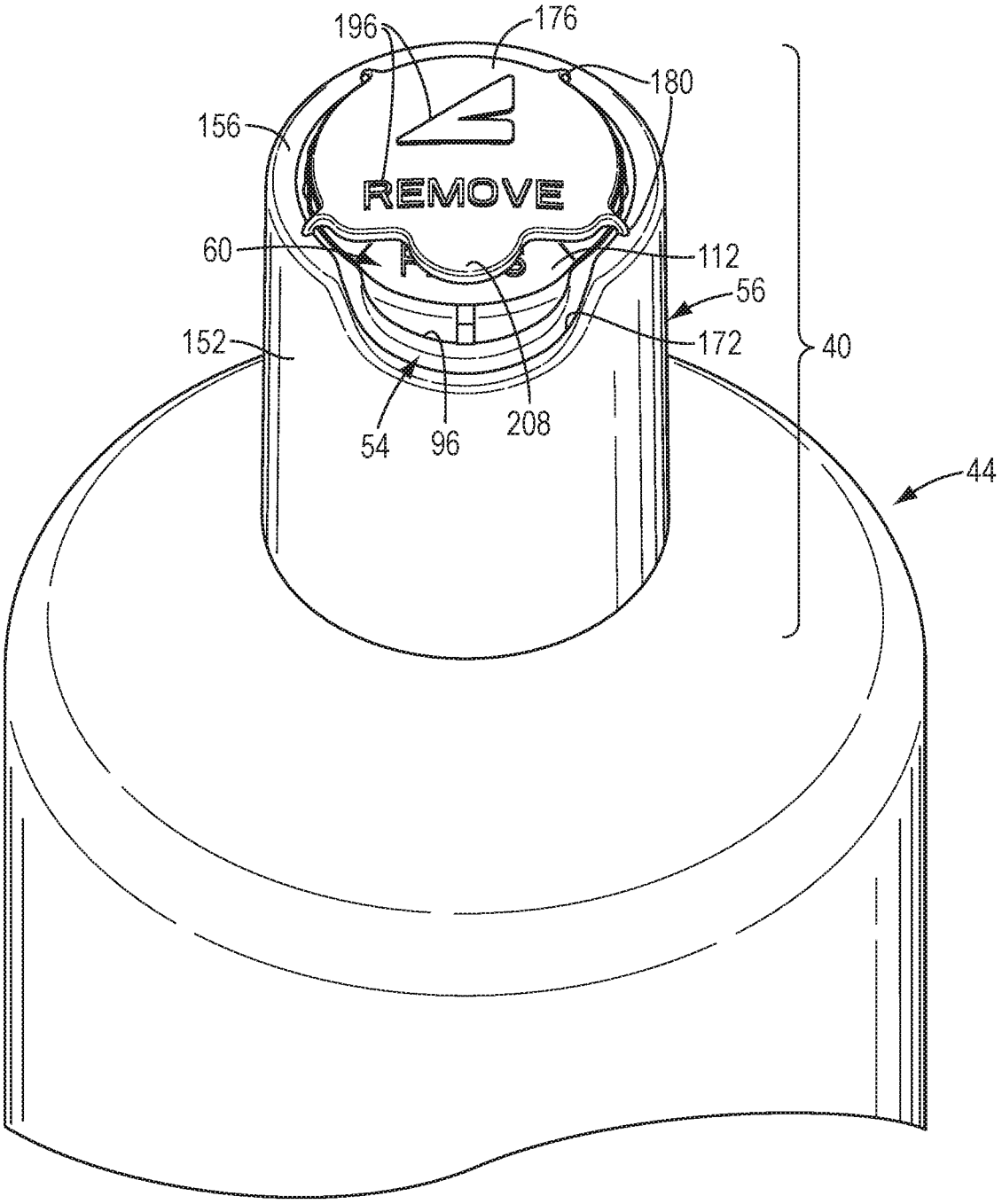
FIG. 2 is a fragmentary, perspective view, taken from above, of the closure and container illustrated in FIG. 1.

As best shown in FIG. 2, the top end 156 of the annular wall 152 includes a cut-out or finger recess 172. The finger recess 172 is located adjacent to the sloping back region 112 of the actuator 60 when the shell 56 is mounted overtop of the closure body 54 and actuator 60.

Figure 15:
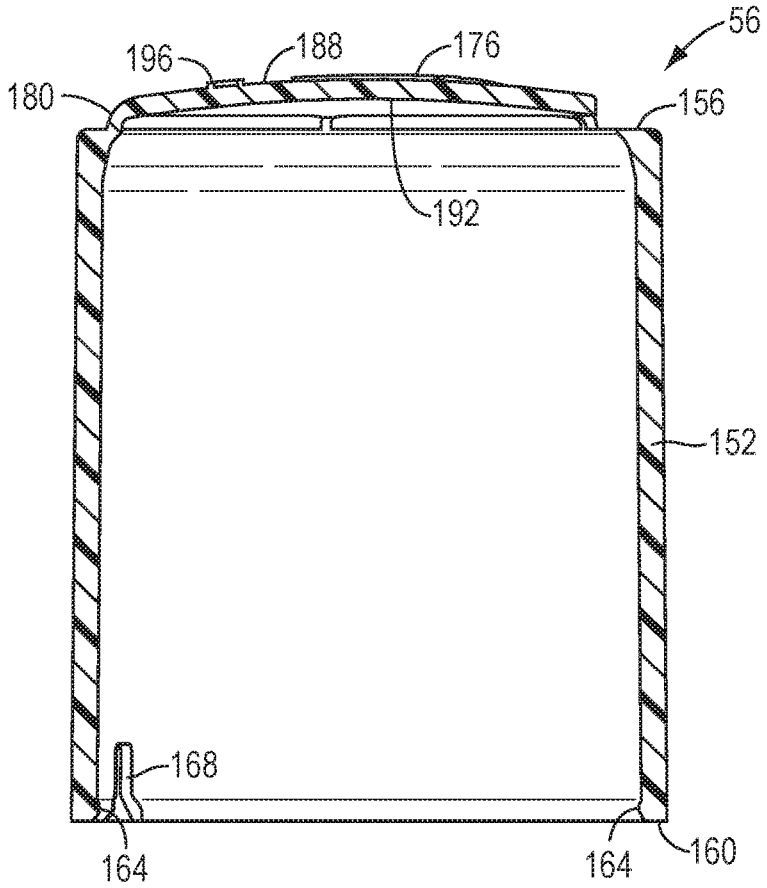
FIG. 15 is a cross-sectional view of the shell illustrated in FIG. 12, taken generally along the plane 15-15 in FIG. 13.

The shell 56 further includes a blocking member or tab 176 connected to the top end 156 by four weakened or frangible connections 180. Each frangible connection 180 is defined by a region of reduced cross-sectional thickness compared to the thickness of the annular wall 152. As discussed herein, the thickness and location frangible connections 180 permit a user to employ a relatively low force to break the frangible connections 180 and to separate the tab 176 from its initial configuration connected to the top end 156 of the annular wall 152. With reference to FIG. 15, it can be seen that each of the frangible connections 180 has an arch-like configuration, extending both laterally inwardly and axially outwardly from the top end 156 to the tab 176.

With reference to FIG. 8, after the user has separated the tab 176 from the annular wall 152, or placed the tab 176 into a "separated configuration", there may be small remnants 184 (visible in FIG. 8) of the frangible connections 180 appearing on top end 156 of the annular wall 152.

Other means of providing a weakened connection between the tab 176 and the annular wall 152 are contemplated, such as providing only a single frangible connection 180 between the two structures, or providing one or more thinned regions of material between the tab 176 and the annular wall 152 by unitary injection molding, or die cutting apertures between the tab 176 and the annular wall 152. In alternative embodiments, not illustrated, it will be appreciated that the tab 176 could be connected to the top end 156 of the shell 56 by a tether, a hinge, or may be frictionally snap-fit or otherwise removably secured to the top end 156 of the shell 56.

The tab 176 has a thin, arcuate cross-sectional shape when viewed along a vertical plane, as shown in FIGS. 14 and 15. The tab 176 has a generally convex exterior surface 188 and a generally concave interior surface 192 facing the hollow interior of the shell 56. The exterior surface 188 has indicia 196 formed or displayed thereon. The indicia 196 may be a graphic, text, texture, or any brand-specific ornamental or functional element. The indicia 196 may be integrally formed with the tab 176, such as by molding, or it may be applied by a secondary manufacturing process, such as by stamping, rolling, printing, plating, applying an adhesive label, bi-injection molding, etc.

The inventors have found that such indicia 196 may be especially desirable where the shell 56 is separately formed from the closure body 54 and the actuator 60. For example, a closure manufacturer may separately provide a unique or custom shell 56 for each particular customer or application, while providing a shared or common closure body 54 and actuator 60 for multiple customers or applications. The closure manufacturer may injection mold the shell 56 in a different mold than the closure body 54 and/or the actuator 60, especially a mold having fewer mold cavities, in order to efficiently and cost-effectively manufacture the inventive closures described herein for a variety of customers. The closure manufacturer may thus utilize a mold with a greater number of mold cavities for the closure body 54 and the actuator 60 in order to efficiently make the greater number of "common" components of the closure 40, which may be shared amongst a variety of customers, bottlers, or fillers. The closure manufacturer may thus use a less expensive mold with a smaller number of mold cavities for the shell 56, which is specific to each individual customer, bottler, or filler.

The inventors have also found that it would be desirable to form the shell 56 (e.g., such as by injection molding) separately from the closure body 54 and/or the actuator 60 such that the shell 56 could have a different texture, colorant, resin, and/or opacity compared to the closure body 54 and/or the actuator 60. Forming the shell 56 separately from the closure body 54 and/or the actuator 60 further allows the shell 56 to be customized for each particular customer or application of the closure 40, while the closure body 54 and/or the actuator 60 of only one common design may be shared amongst a variety of customers, bottlers, or fillers.

Figure 3:
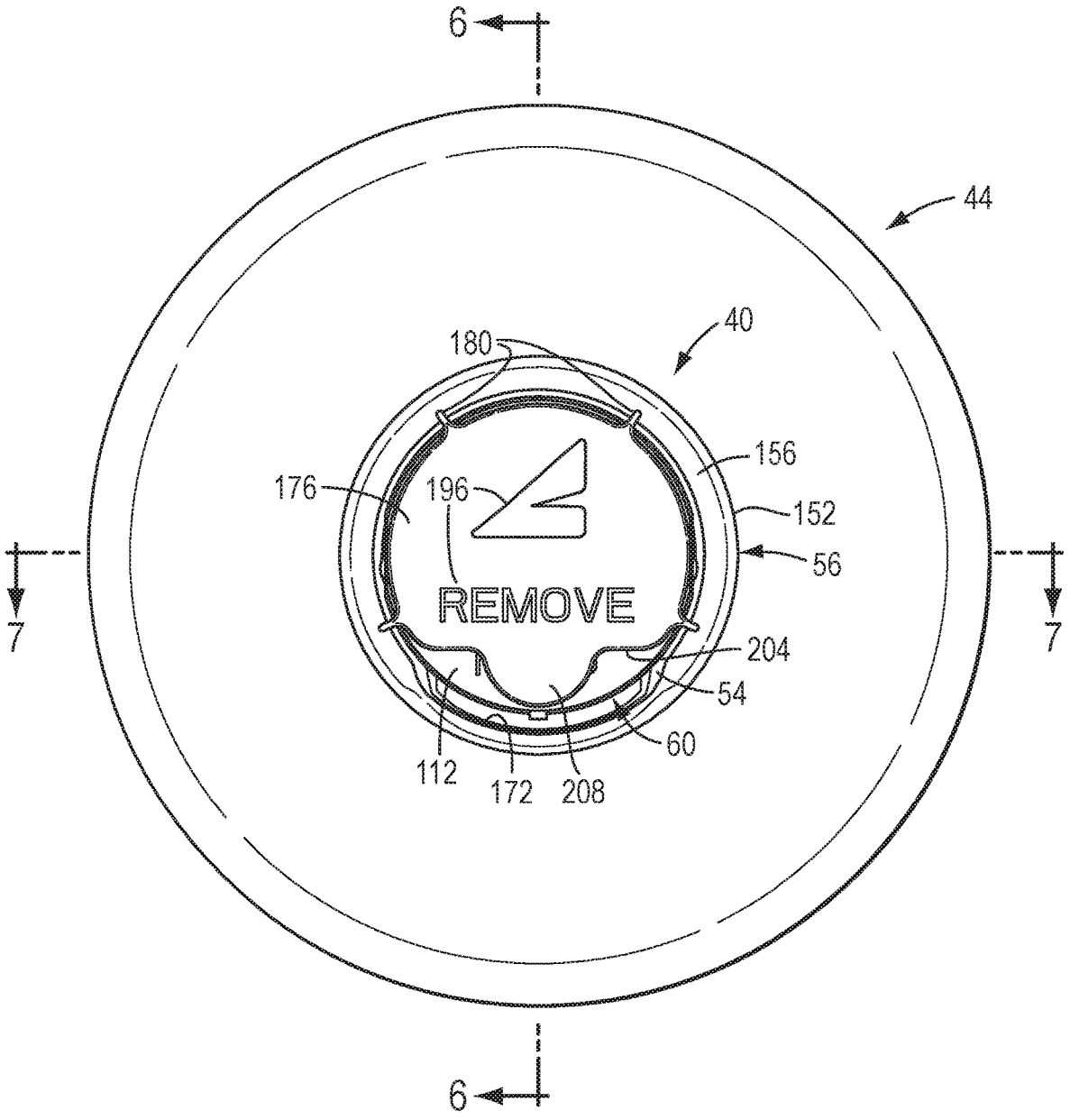
FIG. 3 is a top plan view of the closure and container illustrated in FIG. 1.
Figure 4:
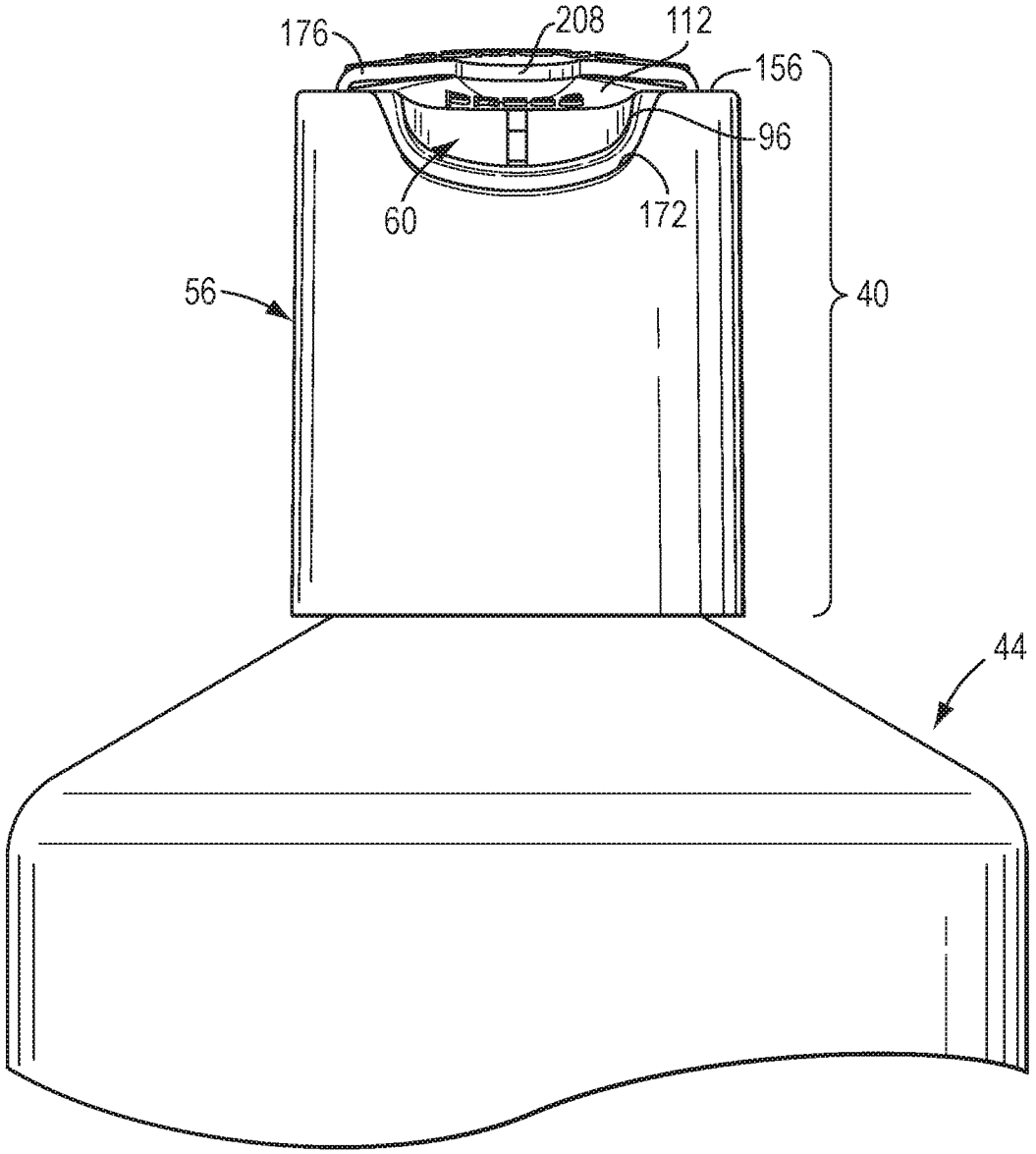
FIG. 4 is a fragmentary, rear elevation view of the closure and container shown in FIG. 1.
Figure 5:
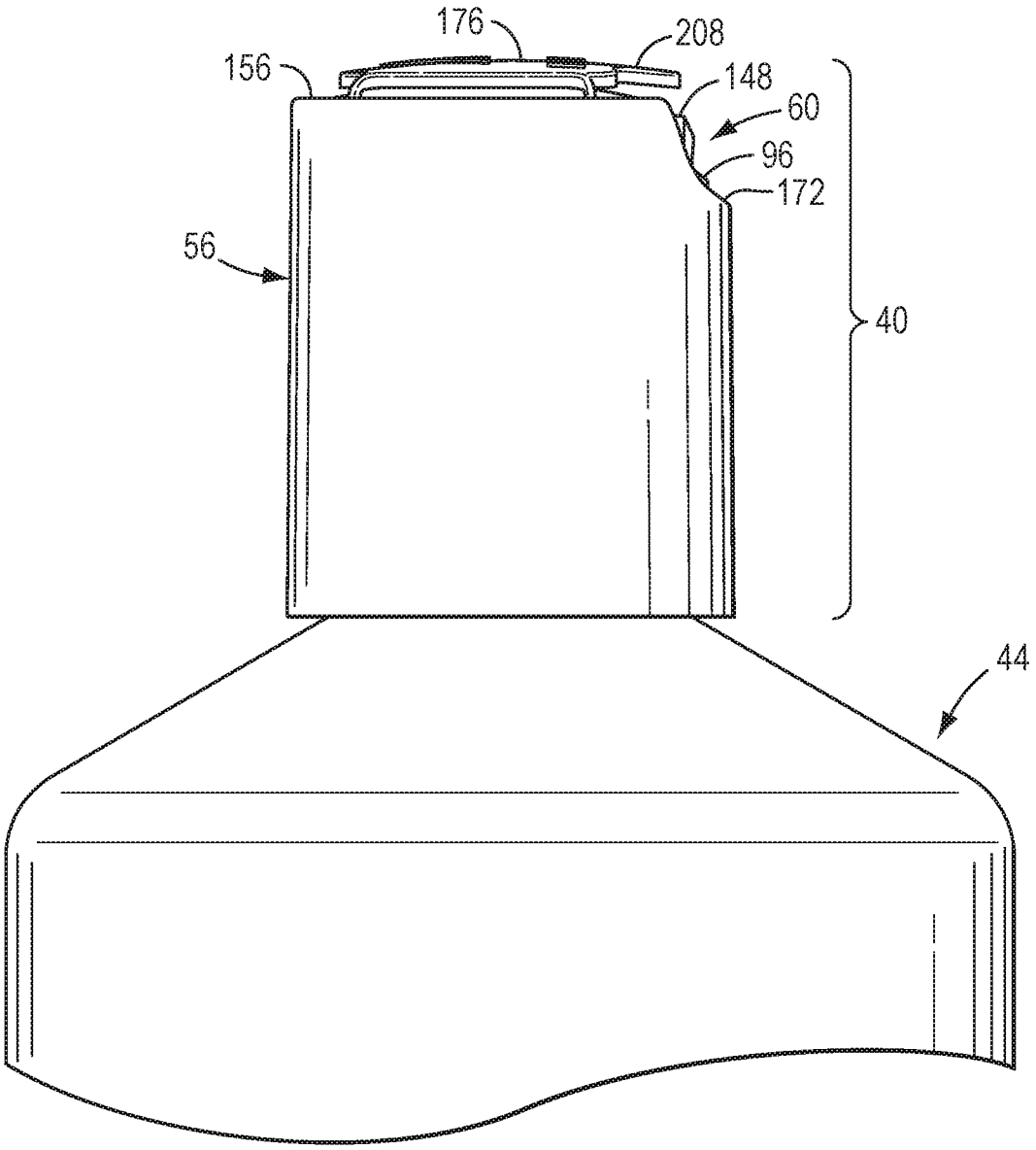
FIG. 5 is a fragmentary, right side elevation view of the closure and container shown in FIG. 1.

With reference to FIG. 3, the tab 176 has a substantially circular shape, with an arcuate perimeter portion 200 that is connected to the top end 156 of the annular wall 152 by the frangible connections 180. The tab 176 has a flattened perimeter portion 204 from which a semi-circular gripping portion or projection 208 extends toward the finger recess 172. The tab 176 extends laterally to overlie the sloping back region 112 of the actuator 60 when the shell 56 is mounted overtop of the closure body 54 in the orientation illustrated in FIGS. 1-10. The projection 208 functions as a location for a user of the closure 40 to grasp the tab 176 and to separate it from the remaining portion of the shell 56, as will be discussed below in greater detail.

As shown in FIGS. 6 and 7, the actuator 60 is carried in the closure body 54, and may pivot about the pivot axis 124 (FIG. 7 only) with respect to the closure body 54 between a closed, non-dispensing position (FIG. 6), and an open, dispensing position (FIG. 10). When the tab 176 is in its as-molded, initial configuration, and the shell 56 is installed or mounted relative to closure body 54 (FIGS. 6 and 7), the concave interior surface 192 of the tab 176 is located directly above the actuator 60. In the initial configuration of the tab 176, the interior surface 192 is located in an abutting or confronting relationship with the actuator 60 to prevent any appreciable pivoting of the actuator 60. Only when the tab 176 has been broken away from the remaining portion of the shell 60, may the actuator 60 be fully pivoted relative to the closure body 54 into the open, dispensing position by a user of the closure 40.

The inventors have found that the advantageous assembly of the closure body 54, shell 56, and the retainer 60 is especially suited for preventing inadvertent leaks of a fluent substance during the shipping and handling of a package that includes the closure 40 attached to a container 44 of a fluent substance—for example, in e-commerce whereby the package may be packed in a number of orientations and shipped in a wide variety of parcels that may be subjected to a wide range of impulse forces, vibrations, pressures, temperatures, and changes in orientation. In addition, the inventors have found that the configuration of the tab 176 and the frangible connections 180 is advantageous for providing a robust solution to prevent unwanted leaks through the closure 40 due to impacts during shipping and for providing an easily removable blocking structure to a variety of users of the closure 40. The compact shape and configuration of the tab 176 allows for the closure 40 to have a low axial height or profile.

One method of assembling the components of the closure 40 is next discussed with initial reference to FIGS. 7 and 11. It will be understood that the method of assembly described herein is illustrative only, and there may be other methods of assembling the components of the closure 40. The actuator 60 and the closure body 54 may be assembled by aligning them with the central axis 20 and orienting the recesses 94 (visible in FIG. 7) in the annular wall 72 of the closure body 54 with the hemispherical protrusions 120 of the actuator 60 such that the sloping back region 112 (visible in FIG. 11) of the actuator 60 is located proximal to the finger recess 96 (visible in FIG. 11) of the closure body wall 72. The actuator 60 and closure body 54 may be subsequently brought together along the central axis 20 until the hemispherical protrusions 120 are pressed into the two the recesses 94, such that the actuator 60 is oriented in the closed, non-dispensing position. One or both of the components (closure body 54 and actuator 60) are formed from a sufficiently resilient material to accommodate the assembly of the two components.

As illustrated in FIG. 6, the plug 136 of the actuator 60 seals against the inside of the spout 88 of the closure body 54 when the actuator 60 is assembled with the closure body 54 and oriented in the non-dispensing, closed position.

Referring now to FIGS. 7 and 11, the subassembly of the actuator 60 and closure body 54 may then be aligned with the central axis 20 and oriented such that (i) the ribs 98 of the closure body 54 are aligned with the slots 168 (visible in FIG. 7), and (ii) the finger recess 172 (visible in FIG. 11) of the shell 56 is aligned with the finger recess 96 (visible in FIG. 11) of the closure body 54. In this orientation, the tab 176 of the shell 56 also overlies the top end 106 of the actuator 60.

With reference to FIG. 6, the shell 56 and the subassembly of the closure body 54 and the actuator 60 are initially oriented to align the shell slots 168 with the closure body ribs 98, and subsequently are pressed together along central axis 20 such that the snap-fit beads 102 of the closure body 54 engage the snap-fit beads 164 on the shell 56 to retain the shell 56 around and over the subassembly of the actuator 60 and closure body 54. As the subassembly of the actuator 60 and closure body 54 is brought together with the shell 56, each rib 98 (FIG. 7) of the closure body 54 is received within a slot 168 (FIG. 7) of the shell 56 to assist in assembly of the closure body 54 together with the shell 56 and to prevent substantial relative rotation between the closure body 54 and the shell 56, resulting in the completed assembly of the components of the closure 40 illustrated in FIGS. 1-7.

The detailed operation and function of the closure 40 will next be described with initial reference to FIGS. 1-2. Typically, a user will encounter the closure 40 with the closure 40 installed upon the top end of a container 44 of a fluent substance—the closure 40, container 44, and fluent substance within the container 44 together defining a package. A removable adhesive, tape, or plastic wrap (not illustrated) may optionally be provided over the top of some portion or all of the closure 40 for purposes of providing a tamper-evident feature or assembly. If such a tamper evident feature is provided, the user would initially remove it from the closure 40 to expose the closure 40 prior to its initial operation. However, in one presently contemplated application, no additional adhesive tape or plastic wrap is provided.

The user would typically encounter the closure 40 as shown in FIGS. 1-2, whereby the shell 56 is mounted atop the closure body 54 (visible in FIG. 2) and the actuator 60 (visible in FIG. 2) is pivotably held within the closure body 54 and is oriented in the closed, non-dispensing position. The user would encounter the tab 176 oriented in an initial configuration, connected to the top end 156 of the annular wall 152 by four frangible connections 180. The projection 208 extends laterally outwardly from the rear region of the tab 176, over the sloping back region 112 (visible in FIG. 2) of the actuator 60 in the direction of the finger recesses 96 and 172 (visible in FIG. 2).

With reference to FIG. 2, with the tab 176 oriented in the initial configuration, the indicia 196 of the tab 176 is legible when viewed from the perspective of the finger recesses 96 and 172. At this stage in operation of the closure 40, if the user were to attempt to move the actuator 60 from the closed position into the open position (e.g., by depressing the sloping back region 112 of the actuator 60 to cause the actuator 60 to pivot relative to the closure body 54), then the user would be prevented from doing so by the engagement or contact between the underside of the tab 176 and the top of the actuator 60. The initial configuration of the tab 176 and closed position of the actuator 60 prevents, or at least minimizes, appreciable rotation (i.e., tilting) of the actuator 60 away from the initially closed position, and that minimizes the potential for accidental dispensing or spilling of the fluent substance if the package is accidentally inverted and/or perhaps accidentally impacted to create a slight increase in internal pressure.

With reference to FIG. 3, the user would begin to open the closure 40 into a dispensing configuration by first grasping the tab 176 by the projection 208, while holding the remaining portion of the shell 56 and/or the container 44, and then subsequently pulling upwardly on the projection 208. When the force exerted by the user reaches a predetermined threshold, the frangible connections 180 nearest to the projection 208 would break and the tab 176 would begin to rotate or lift away from the remaining portion of the shell 56. As the user continues to pull upwardly on the tab 176, the remaining frangible connections 180 would break and the tab 176 would be fully detached or separated from the remaining portion of the shell 56. As can be seen in FIGS. 8 and 9, remnants 184 of the frangible connections 80 may remain on the top end 156 of the annular wall 152. The tab 176 functions in this manner in only a single use or application, and may subsequently be discarded or recycled by the user.

With reference to FIGS. 9 and 10, upon the removal of the tab 176 from the shell 56, the user may move the actuator 60 from the closed, non-dispensing position into the open, dispensing position by depressing the sloping back region 112 of the actuator 60 with a finger or thumb while holding the remaining portion of the shell 56 and/or the container 44. When the force exerted by the user on the back region 112 reaches a predetermined threshold, the hemispherical protrusions 120 of the actuator 60 pivot within the recesses 94 (visible in FIG. 7 only) of the closure body 54 such that the front region 108 of the actuator 60 rises sufficiently to expose the outlet end 132 (FIG. 10) of the dispensing flow passage 124 (FIG. 10).

During rotation of the actuator 60 into the open position, the cam element 148 (FIG. 9) slides down into the closure body 54 against the wall 72. The cam element 148 stabilizes and maintains the actuator 60 in the open position by frictional engagement with the wall 72. Some slight flexing of one or more of the components may occur to accommodate the sliding engagement between the cam element 148 and the closure body 54.

Referring now to FIG. 6, as the actuator 60 pivots into the open position, the plug 136 lifts partially out of the spout 88 so that the outlet end 132 of the dispensing flow passage 124 is exposed to the ambient environment. The user may then grasp and squeeze the flexible, resilient container 44 to compress the container 44 or otherwise reduce the internal volume of the container 44 to pressurize the fluent substance contained therein. In some situations, the user may also invert the container 44. In any event, during dispensing of the fluent substance, the fluent substance initially enters the inlet flow passage 74 of the closure body 54, flows through the spout 88, then flows into the dispensing flow passage 124 of the actuator 60, and exits the closure 40 from the exposed outlet end 132 of the actuator 60.

When the user ceases to squeeze (i.e., pressurize) the container 44, the outward flow of the fluent substance is stopped and may even be sucked back toward the container 44 by a temporary lower pressure within the container 44 (e.g., if the container has resilient walls that return from a "squeezed in" configuration to the normal, non-deformed configuration). This allows some of the fluent substance within the dispensing flow passage 124, the spout 88, and/or the inlet flow passage 74 to be forced by the greater ambient air pressure back through the closure 40 and toward the container 44 to help maintain the overall cleanliness of the package.

After a fluent substance has been dispensed from the package, the user may move the actuator 60 from the open position into the closed position by depressing the front region 108 of the actuator 60 to pivot (i.e., tilt) the actuator 60 in a way that lowers the front region 108 back within the closure body 54 and raises the sloping back region 112 upwards. The pivoting movement of the actuator 60 relative to the closure body 54 causes the plug 136 of the actuator 60 to re-seal within the spout 88 of the closure body 54 and further conceals the outlet end 132 of the dispensing flow passage 124 from the ambient environment.

Figure 18:
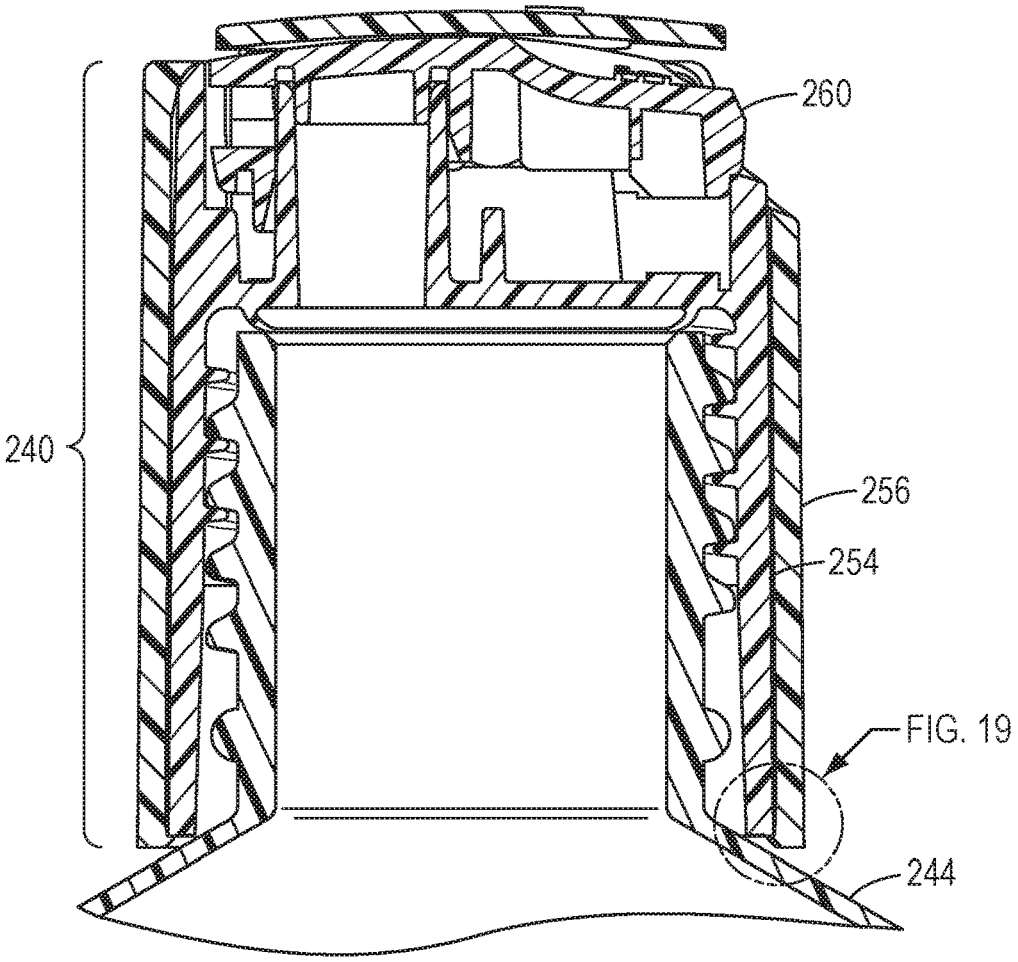
FIG. 18 is a cross-sectional view of a second embodiment of a closure of the present invention shown installed at the opening of a container wherein only a fragmentary, upper portion of the container is illustrated in FIG. 18.
Figure 19:
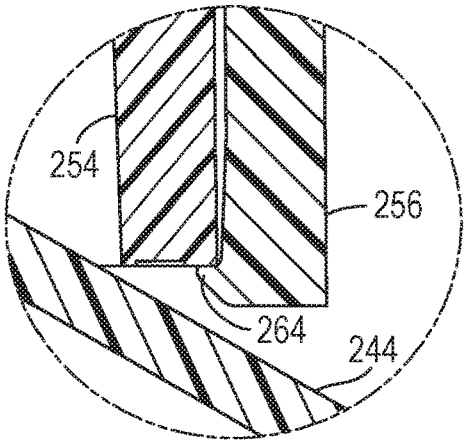
FIG. 19 is a greatly enlarged, fragmentary view of the portion of the second embodiment of the closure and the container enclosed in the circle designated as "FIG. 19" in FIG. 18.

A second embodiment of a closure 240 according to the present invention is assembled with a container 244 of a fluent substance and is illustrated in FIGS. 18 and 19. The second embodiment of the closure 240 can be formed from the same material or materials, as discussed above with respect to the first illustrated embodiment of the closure 40. The second illustrated embodiment of the closure 240 also functions generally in the same manner as the first illustrated embodiment of the closure 40, and includes the same basic components of a closure body 254, a shell 256, and an actuator 260.

The second illustrated embodiment of the closure 240 differs from first illustrated embodiment of the closure 40 in that the second shell 256 is assembled together with the closure body 254 in a manner that does not require any complementary ribs or slots on either component of the closure 240. With reference to FIG. 19, it can be seen that the bottom end of the shell 260 has a radially inwardly extending hook or projection 264 for engaging a bottom edge of the closure body 254. The projection 264 functions, together with engagement between the interior, top end of the shell 256 and the top end of the closure body 254, to clamp the shell 256 about the closure body 254 to thus prevent relative axial movement between the shell 256 and the closure body 254. For at least some applications, providing the clamping features, such as the projection 264, solely on the shell 260 component of the closure 240 may serve to reduce manufacturing costs and improve the manufacturability of the closure 240.

While the illustrated projection 264 has sloping lead-in surface and a substantially flat trailing surface, it will be appreciated that other structures may be used to retain the shell 260 together with closure body 254, such as an arcuate, snap-fit bead or deflecting finger (not illustrated) that extends inwardly from the bottom end of the shell 256 to engage some portion of the closure body 254.

Various modifications and alterations to this invention will become apparent to those skilled in the art without departing from the scope and spirit of this invention. The illustrative embodiments and descriptions of modifications thereto are provided herein as examples only, and are not intended to limit the scope of the present invention.

What is claimed is:

1. A closure for a system having an opening between an exterior of the system and an interior of the system where a fluent substance may be stored, said closure comprising:

A. a closure body that can be located at the system opening and that defines a through passage for communicating with the system to accommodate the flow of a fluent substance through said closure body;

B. an actuator that is rotatably mounted to said closure body for occluding said through passage of said closure body to prevent flow of a fluent substance through said closure when said actuator is in a closed, non-dispensing position and for permitting flow of a fluent substance through said closure when said actuator is rotated to an open, dispensing position; and C. a shell that is mounted around at least a portion of said closure body, said shell having a top end and a blocking member with an initial configuration and a separated configuration, wherein in said initial configuration said blocking member is connected to said top end to prevent said actuator from moving into said open, dispensing position, and wherein in said separated configuration said blocking member is at least partially separated from said top end to allow said actuator to move into said open, dispensing position; and wherein said blocking member defines a projection extending laterally from a portion of said blocking member, and said actuator has a top end defining a sloping back region, wherein in said initial configuration, said projection extends laterally over said sloping back region.

2. A closure for a system having an opening between an exterior of the system and an interior of the system where a fluent substance may be stored, said closure comprising:

A. a closure body that can be located at the system opening and that defines a through Passage for communicating with the system to accommodate the flow of a fluent substance through said closure body;

B. an actuator that is rotatably mounted to said closure body for occluding said through passage of said closure body to prevent flow of a fluent substance through said closure when said actuator is in a closed, non-dispensing position and for permitting flow of a fluent substance through said, closure when said actuator is rotated to an open, dispensing position; and C. a shell that is mounted around at least a portion of said closure body, said shell having a top end and a blocking member with an initial configuration and a separated configuration, wherein in said initial configuration said blocking member is connected to said top end to prevent said actuator from moving into said open, dispensing position, and wherein in said separated configuration said blocking member is at least partially separated from said top end to allow said actuator to move into said open, dispensing position; and wherein said blocking member defines a laterally-extending projection and said shell has a generally cylindrical outer wall with a finger recess formed therein, said projection extending laterally outwardly toward said finger recess in said initial configuration.

3. A closure for a system having an opening between an exterior of the system and an interior of the system where a fluent substance may be stored, said closure comprising:

A. a closure body that can be located at the system opening and that defines a through passage for communicating with the system to accommodate the flow of a fluent substance through said closure body;

B. an actuator that is rotatably mounted to said closure body for occluding said through passage of said closure body to prevent flow of a fluent substance through said closure when said actuator is in a closed, non-dispensing position and for permitting flow of a fluent substance through said closure when said actuator is rotated to an open, dispensing position; and C. a shell that is mounted around at least a portion of said closure body, said shell having a top end and a blocking member with an initial configuration and a separated configuration, wherein in said initial configuration said blocking member is connected to said top end to prevent said actuator from moving into said open, dispensing position, and wherein in said separated configuration said blocking member is at least partially separated from said top end to allow said actuator to move into said open, dispensing position; and wherein said closure body is provided with a pair of diametrically-spaced ribs and a pair of diametrically-spaced snap-fit beads extending between said ribs, and said shell is provided with a pair of diametrically-spaced slots and a pair of diametrically-spaced snap-fit beads extending between said slots.

* * * * *